US010577156B2

(12) United States Patent
Dagnelie et al.

(10) Patent No.: US 10,577,156 B2
(45) Date of Patent: Mar. 3, 2020

(54) CONTAINER SYSTEMS

(71) Applicant: The Procter & Gamble Company, Cincinnati, OH (US)

(72) Inventors: Thierry Christian Francis Dagnelie, Waterloo (BE); Vincent Hubert M. De Wilde, Kessel-Lo (BE); Raf Gustaaf Alfons Degeyter, Herk-De-Stad (BE); Simone Pallotto, Etterbeek (BE); Katrien De Malsche, Hamme (BE); Clara Sophie Lea Ng Pak Leung, Ixelles (BE); David Brian Dawson, Greensboro, NC (US); Joshua Miles Glessner, High Point, NC (US)

(73) Assignee: The Procter & Gamble Company, Cincinnati, OH (US)

( * ) Notice: Subject to any disclaimer, the term of this patent is extended or adjusted under 35 U.S.C. 154(b) by 69 days.

(21) Appl. No.: 15/807,607

(22) Filed: Nov. 9, 2017

(65) Prior Publication Data

US 2019/0119012 A1 Apr. 25, 2019

Related U.S. Application Data

(60) Provisional application No. 62/420,605, filed on Nov. 11, 2016.

(51) Int. Cl.

| | |
|---|---|
| ***B65D 43/16*** | (2006.01) |
| ***B65D 50/04*** | (2006.01) |
| ***E05C 3/04*** | (2006.01) |
| ***B65D 55/12*** | (2006.01) |
| ***B65D 43/22*** | (2006.01) |

(52) U.S. Cl.

CPC ..... *B65D 43/163* (2013.01); *B65D 43/22* (2013.01); *B65D 50/04* (2013.01); *B65D 50/046* (2013.01); *B65D 55/12* (2013.01); *E05C 3/041* (2013.01); *B65D 2251/1058* (2013.01)

(58) Field of Classification Search

CPC .. B65D 45/327; B65D 43/022; B65D 43/163; B65D 21/0219

USPC ..... 220/810, 281

See application file for complete search history.

(56) References Cited

U.S. PATENT DOCUMENTS

| | | | |
|---|---|---|---|
| 5,671,853 | A | 9/1997 | Herr |
| 5,836,465 | A | 11/1998 | King |
| 6,059,135 | A | 5/2000 | James |
| 6,092,690 | A | 7/2000 | Bitowft |
| 6,367,639 | B1 | 4/2002 | Mar |
| 6,371,316 | B1 | 4/2002 | Herr et al. |
| 6,499,626 | B1 | 12/2002 | Julius |

(Continued)

FOREIGN PATENT DOCUMENTS

| | | |
|---|---|---|
| CN | 202358450 U | 8/2012 |
| CN | 303188596 | 4/2015 |

(Continued)

OTHER PUBLICATIONS

U.S. Appl. No. 15/807,608, filed Nov. 9, 2017, Nicolas Robert Nuno Cromarty Oliveira.

(Continued)

*Primary Examiner* — Shawn M Braden

(74) *Attorney, Agent, or Firm* — Gregory S. Darley-Emerson

(57) ABSTRACT

Container systems. Closure systems. Related processes.

19 Claims, 22 Drawing Sheets

(56) References Cited

U.S. PATENT DOCUMENTS

| | | | | |
|---|---|---|---|---|
| 6,655,544 | B1 | 12/2003 | Tanaka et al. | |
| 6,951,292 | B2 | 10/2005 | Bando et al. | |
| 6,986,434 | B1 | 1/2006 | Getsy et al. | |
| 7,073,679 | B1 | 7/2006 | Lagler et al. | |
| 7,290,673 | B2 | 11/2007 | Hagano | |
| 7,753,228 | B2 | 7/2010 | Yuhara | |
| 7,988,014 | B2 | 8/2011 | Jan et al. | |
| D653,105 | S | 1/2012 | Degeyter et al. | |
| 8,360,257 | B2 | 1/2013 | Sebille et al. | |
| 8,371,463 | B2 | 2/2013 | Beecroft | |
| 8,540,116 | B2 | 9/2013 | Giraud et al. | |
| 8,720,740 | B2 | 5/2014 | Bratsch | |
| 8,973,242 | B2 | 3/2015 | Damaghi et al. | |
| 9,150,340 | B2 | 10/2015 | Pawlik | |
| 9,359,114 | B2 * | 6/2016 | Wong | B65D 43/26 |
| 9,718,589 | B2 | 8/2017 | Kopulos et al. | |
| 2008/0041869 | A1 * | 2/2008 | Backaert | B65D 39/025 220/804 |
| 2009/0020493 | A1 | 1/2009 | Yeager | |
| 2011/0204087 | A1 * | 8/2011 | Kopulos | B65D 21/0219 220/810 |
| 2011/0309098 | A1 | 12/2011 | Hayashi et al. | |
| 2012/0325691 | A1 | 12/2012 | Wang | |
| 2013/0037540 | A1 * | 2/2013 | Sze | B65D 43/022 220/237 |
| 2014/0151388 | A1 | 6/2014 | Culeron et al. | |
| 2014/0305819 | A1 | 10/2014 | Hill et al. | |
| 2016/0000245 | A1 | 1/2016 | Sims | |
| 2017/0349341 | A1 | 12/2017 | Girardot et al. | |
| 2017/0349342 | A1 * | 12/2017 | Girardot | B65D 41/0471 |

FOREIGN PATENT DOCUMENTS

| | | | |
|---|---|---|---|
| DE | 202014010527 | U1 | 12/2015 |
| EM | 000091103-0001 | | 2/2004 |
| EM | 000091103-0002 | | 2/2004 |
| EM | 000101829-0002 | | 2/2004 |
| EM | 000101829-0005 | | 2/2004 |
| EM | 000810841-0001 | U | 11/2007 |
| EM | 000799788-0002 | | 6/2009 |
| EM | 002693002-0001 | | 5/2015 |
| EM | 002693002-0002 | | 5/2015 |
| EM | 002693002-0003 | | 5/2015 |
| EM | 002693002-0004 | | 5/2015 |
| EM | 002289256-0001 | | 8/2015 |
| EP | 0609955 | A1 | 8/1994 |
| EP | 0957037 | A2 | 11/1999 |
| EP | 2628688 | A1 | 8/2013 |
| JP | H09315453 | A | 12/1997 |
| JP | 2001048210 | A | 2/2001 |
| JP | 2003170950 | A | 6/2003 |
| JP | D1409814 | | 3/2011 |
| WO | WO2007110106 | A1 | 10/2007 |

OTHER PUBLICATIONS

U.S. Appl. No. 15/807,609, filed Nov. 9, 2017, Thierry Christian Francis Dagnelie.

U.S. Appl. No. 15/807,610, filed Nov. 9, 2017, Vincent Hubert M. De Wilde.

PCT Search Report for appl. No. PCT/US2017/060976, dated Feb. 21, 2019, 6 pages.

* cited by examiner

CONTAINER SYSTEMS

FIELD OF THE INVENTION

The present disclosure relates to container systems, closure systems, and related processes.

BACKGROUND OF THE INVENTION

Container systems having press-and-turn and squeeze-and-turn closures are known. Such container systems are typically useful because opening them requires a plurality of coordinated motions, making them more secure than ordinary containers.

However, such container systems having such closures suffer from a variety challenges. The closure, which typically screws off of the container, may become separated from the container and get lost. Aligning the threads of such screw-off closures with their containers can be challenging for users that have limited manual dexterity. Furthermore, the openings of the containers must usually be limited in size, because the closure must be able to fit over the opening of the container. It can also be challenging to provide a container system with a large container opening to allow for efficient filling while still providing a closure mechanism that is small enough to conveniently and ergonomically operate.

There is a need for improved container systems and/or closure systems.

SUMMARY OF THE INVENTION

The present disclosure relates to container systems, closure systems, and related processes.

The present disclosure relates to container systems that include: a container with an opening that provides access to a storage volume; and a lid hingedly connected to the container, the lid having a closed position in which the lid covers the opening and an open position in which the lid does not cover the opening, the lid having a first portion and a second portion, where the first portion is non-integrally connected to the second portion, and where moving the first portion from a first position to a second position allows the lid to be moved from the closed position to the open position.

The present disclosure relates to container systems that include: a container with an opening that provides access to a storage volume, and a closure system, the closure system including a cover and optionally a frame, the cover being hingedly connected to the container or optional frame and moveable from a closed position that blocks access to the storage volume and an open position that allows access to the storage volume, and a dial rotatably connected to the cover, the dial having at least one push pad, the dial having at least one engagement structure removeably engageable with the container or optional frame, where the engagement structure, when engaged with the container or optional frame, prevents the lid from moving from the closed position to the open position, where pressing on the push pad allows the dial to rotate relative to the cover and thereby disengage the engagement structure with the container or optional frame to allow the cover to be moveable to the open position.

The present disclosure relates to closure systems that include a lid hingedly connected to a frame, the frame configured to be connectable to an open end of a container, and the lid including a first portion and a second portion, where the first portion is non-integrally connected to the second portion, and where moving the first portion from a first position to a second position allows the lid to be moved from a closed position to an open position relative to the frame.

The present disclosure relates to a process of filling a container system with a material, the process including the following steps: providing a container body, where the body includes a storage volume; providing a material to the storage volume; providing a closure system to the body, where the closure system includes a lid hingedly connected to a frame, the frame being connectable to an open end of the container body, the lid comprising a first portion and a second portion, the first portion being non-integrally connected to the second portion, where moving the first portion from a first position to a second position allows the lid to be moved from a closed position to an open position relative to the frame.

The present disclosure relates to a process of making a closure system, the process including the following steps: providing a cover and a frame, where the cover is hingedly connected to the frame; and connecting a rotatable dial to the cover to form a closure system.

The present disclosure relates to a process of accessing a container system, the process including the following steps: providing a container system as described herein; moving the first portion of the lid from the first position to the second position relative to the second portion; moving the lid from the closed position to the open position; removing at least some material from the storage volume; closing the container system by moving the lid from the open position to the closed position.

BRIEF DESCRIPTION OF THE DRAWINGS

The figures herein are illustrative in nature and are not intended to be limiting.

DETAILED DESCRIPTION OF THE INVENTION

Figure 1:
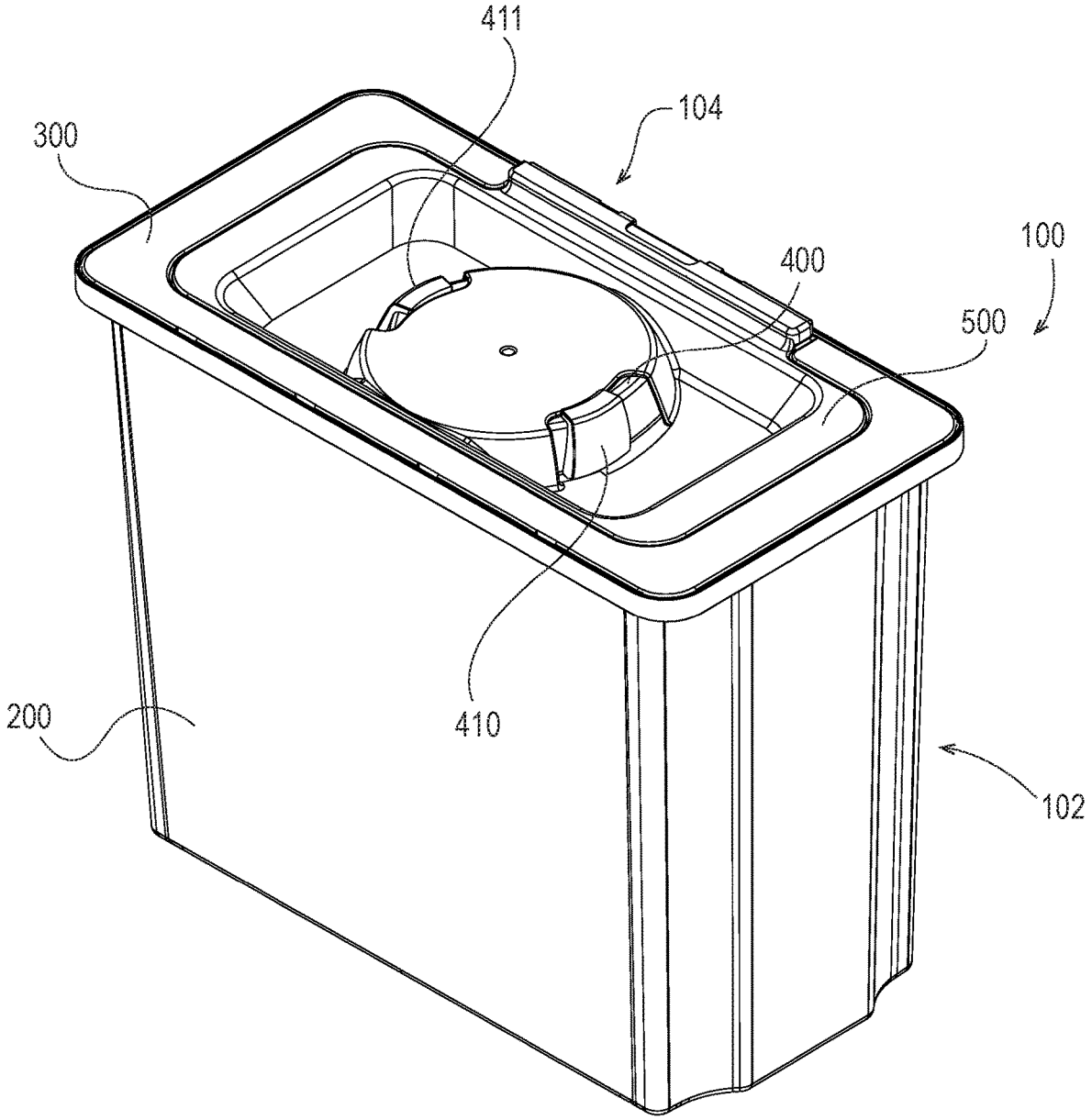
FIG. 1 shows a container system according to the present disclosure.

The present disclosure relates to container systems that include improved closure mechanisms. The container systems may include a lid having a first portion and a second portion, where the first portion is non-integrally connected to the second portion, and where moving the first portion from a first position to a second position allows the lid to be moved from a closed position to an open position. The first portion may include one or more push pads that must be pressed in order for the lid to be moved to an open position. The first portion may be rotatable and may need to be rotated in order for the lid to be moved to the open position. In order to open the lid, push pads may need to be pressed and the first portion may need to be rotated. The present disclosure also relates to closure systems and lids that include similar mechanisms.

The container systems of the present disclosure and related processes are described in more detail below.

As used herein, the articles "a" and "an" when used in a claim, are understood to mean one or more of what is claimed or described. As used herein, the terms "include," "includes," and "including" are meant to be non-limiting. The compositions of the present disclosure can comprise, consist essentially of, or consist of, the components of the present disclosure.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included. The indicated material may be present, if at all, at a level of less than 1%, or less than 0.1%, or less than 0.01%, or even 0%, by weight of the composition.

As used herein the phrase "fabric care composition" includes compositions and formulations designed for treating fabric. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation.

Unless otherwise noted, all component or composition levels are in reference to the active portion of that component or composition, and are exclusive of impurities, for example, residual solvents or by-products, which may be present in commercially available sources of such components or compositions.

All temperatures herein are in degrees Celsius (° C.) unless otherwise indicated. Unless otherwise specified, all measurements herein are conducted at 20° C. and under the atmospheric pressure.

In all embodiments of the present disclosure, all percentages are by weight of the total composition, unless specifically stated otherwise. All ratios are weight ratios, unless specifically stated otherwise.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Container System

The present disclosure relates to container systems. As shown in FIG. 1, the container system 100 may include a container 102 and a lid 104. The container 102 may include a body 200 and a frame 300. The lid 104 may include a first portion 400, which may be in form of a dial, and a second portion 500, which may be in the form of a cover.

The container system 100 or components thereof may be made of any suitable material. The body 200 may be molded from a suitable plastic material such as polyethylene terephthalate. Any suitable polyolefins and/or polyesters may be used. The frame 300 and/or lid 104 or portions thereof may be formed partially or wholly of a moldable thermoplastic material, such as polypropylene, polyethylene, polystyrene, acrylonitryl butadiene styrene (ABS), polyester, polyvinyl chloride, polycarbonate or elastomer, or a blend of these materials.

The container body 200 may be formed of a clear, transparent, or semi-transparent material, while the frame 300 and/or lid 104 may be formed of a substantially opaque material. The entire container system 100 may be formed of substantially opaque materials. The materials used to form the container system 100 may have one or more colors. The container body 200, frame 300, and/or lid 104 may all of the same color (e.g., all orange or all green). The lid 104 may have a major color and a minor color. The lid 104 may comprise a first portion 400 (e.g., a dial) of a first color and a second portion (e.g., a cover) of a second color. The first and second colors may be different, which may help to make the first portion 400 or portions thereof (e.g., push pads 410, 411) stand out visually.

Figure 2:
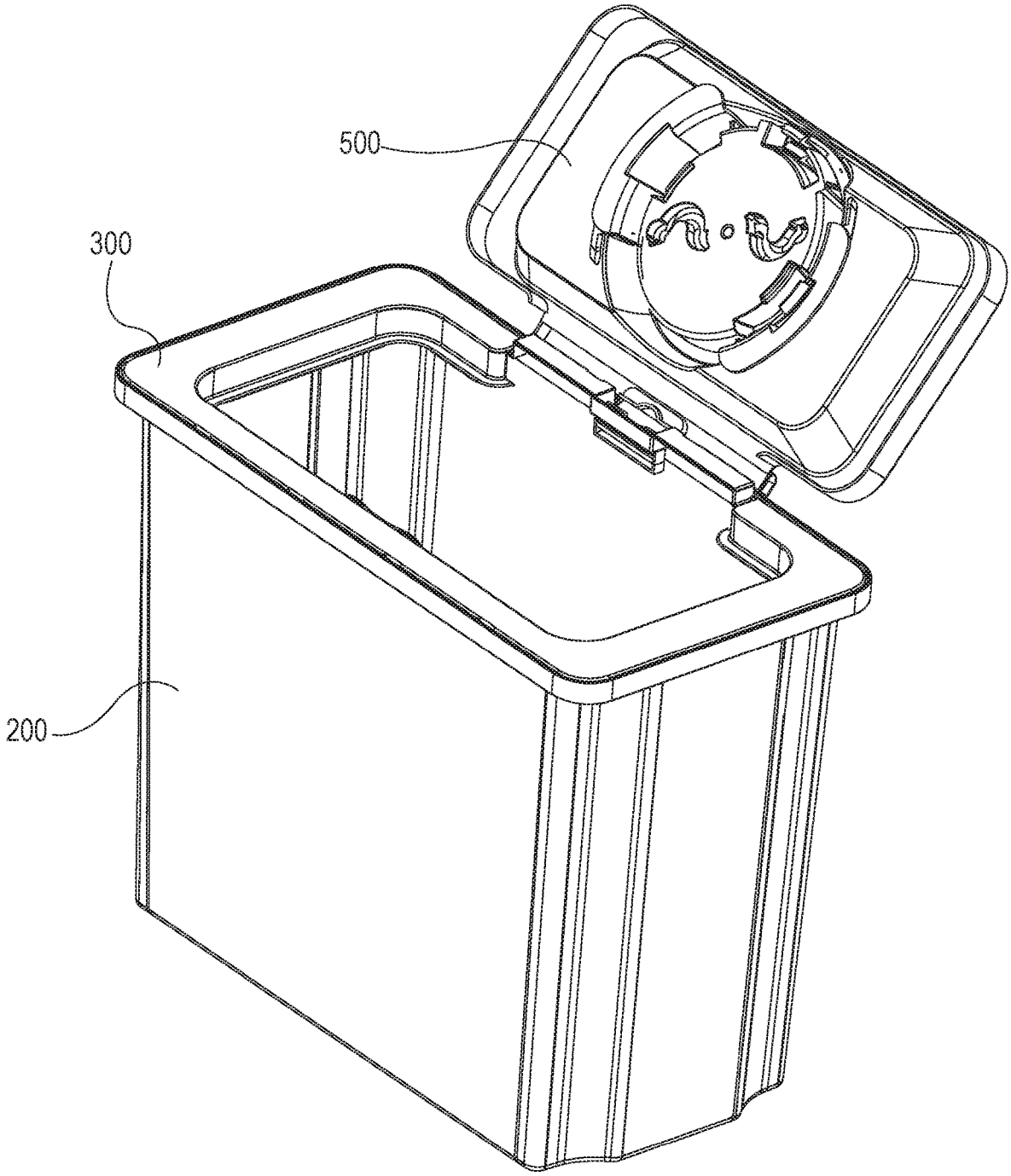
FIG. 2 shows an exploded view of a container system according to the present disclosure.

As shown in FIG. 2, the lid 104, for example the second portion 500, may be hingedly connected to the frame 300. The frame 300 may connect to the body 200. The first portion 400 of the lid 104 may connect to the second portion 500. The first portion 400 is typically non-integrally connected to the second portion 500.

Figure 3:
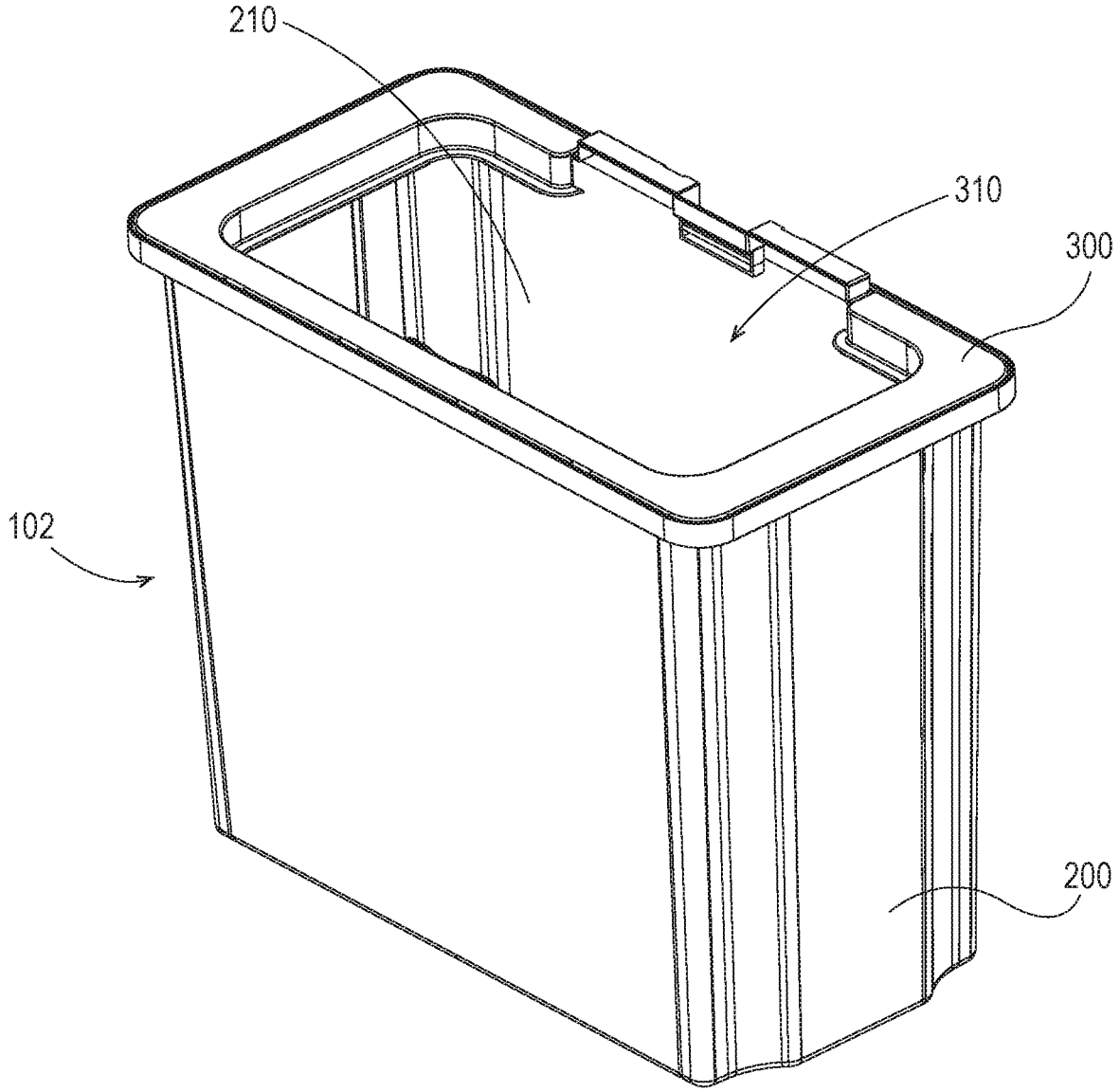
FIG. 3 shows a container according to the present disclosure.

As shown in FIG. 3, the container may include a body 200 and a frame 300 that connects to the body 200. The frame 300 may define an opening 310. The opening 310 may provide access to a storage volume 210 of the body 200.

Figure 4:
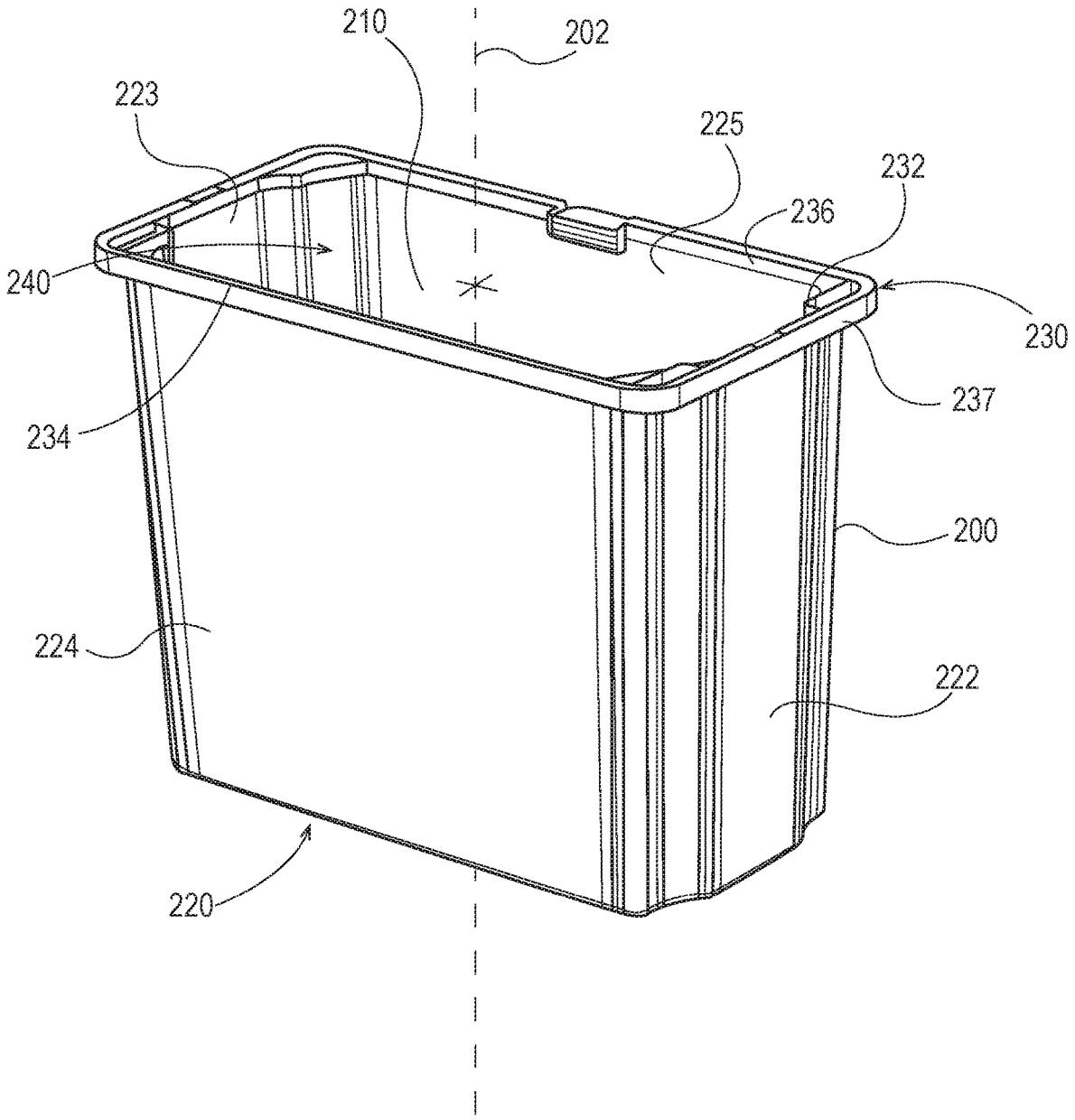
FIG. 4 shows a container body according to the present disclosure.

As shown in FIG. 4, the body 200 may include a bottom wall 220 and at least one side wall 222. The walls of the body 200 may define the storage volume 210 and may be in any suitable shape, for example the shape of a cylindrical or a rectangular container. The body may include a front wall 224, a rear wall 225, and two side walls 222, 223. The walls 222, 223, 224, 225 may be substantially flat, convex, or a mixture thereof.

The walls 222, 223, 224, 225 may include flat portions or even concave portions that extend inwardly towards the storage volume 210. Instead of having pointed or convexly rounded corners, the body 200 may include corners that are flat and/or concave. A cross-section of at least a portion of the body 200 may have a substantially octagonal shape. The flat and/or concave portions may be located near the opening 240 of the body 200. The flat and/or concave portions may provide a gripping surface that makes the containers easier to be grabbed and/or picked up by a consumer. The flat and/or concave portions may also make the containers easier to be picked up by robot arms when being moved by the manufacturer during filling and/or packing, for example, when being placed into or onto secondary packaging, such as a box, a crate, or a pallet.

The body 200 may include a neck 230. The neck 230 may terminate in a rim 232. The rim 232 may define an opening 240 of the body 200. The opening 240 may have a periphery 234. The neck 240 may have an inner surface 236 that faces a central axis 202 of the opening 240. The neck 230 may have an outer surface 237 that is opposite the inner surface 236 of the neck 230 and faces away from the central axis 202.

Figure 5:
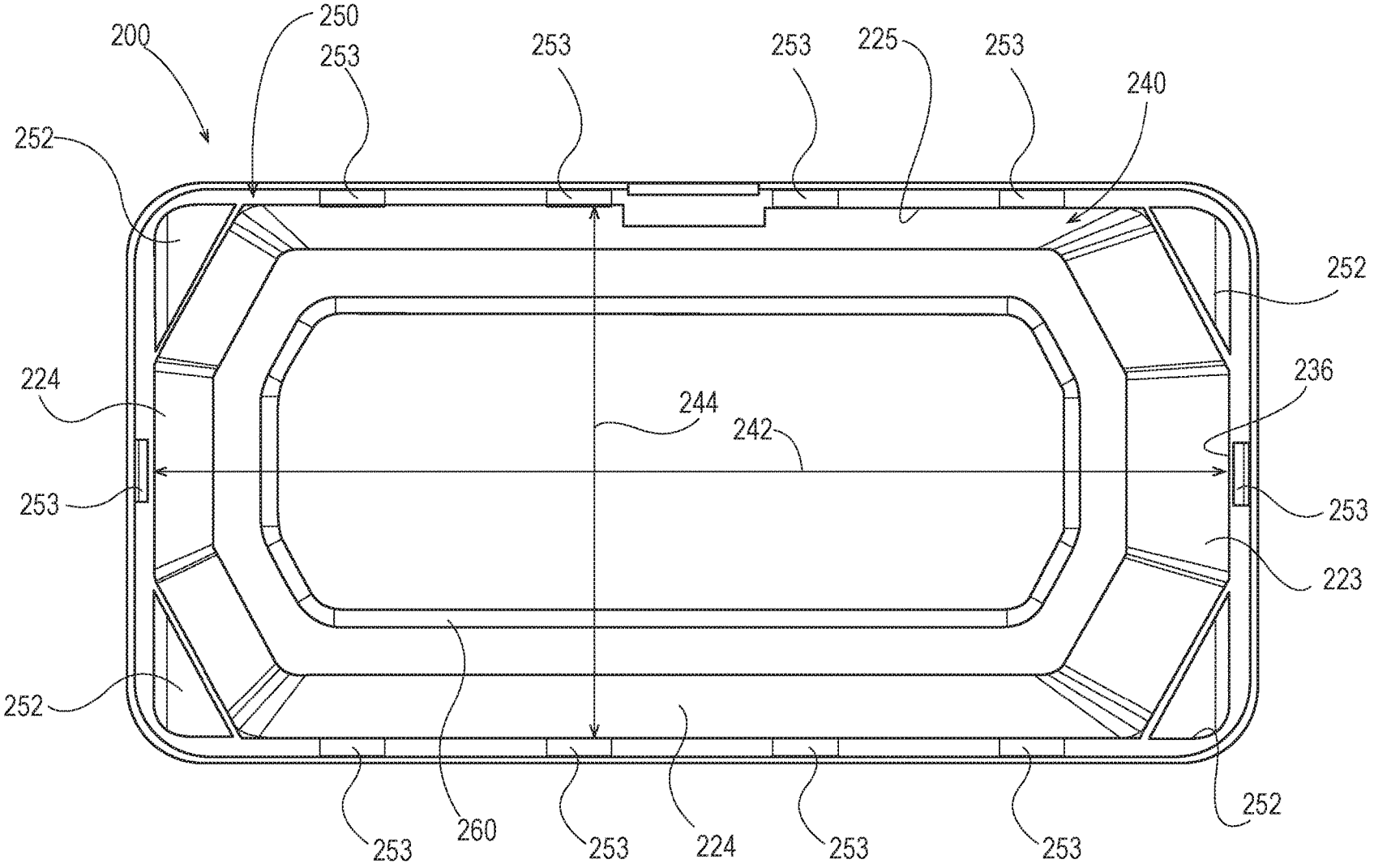
FIG. 5 shows a top view of a container body according to the present disclosure.

It may be desirably for the body to have a relatively large opening 240, for example, in order to facilitate filling the container with contents. As shown in FIG. 5, the opening 240 of the body 200 may have a major dimension 242, as measured from the inner surface 236 of the neck 230 to the opposite side. The major dimension 242 may have a length of from 100 mm, or from about 125 mm, or from about 150 mm, to about 300 mm, or to about 250 mm, or to about 200 mm.

The opening 240 of the body 200 may have a minor dimension 244, as measured from the inner surface 236 of the neck 240 to the opposite side. The minor dimension is typically perpendicular to the major dimension. The minor dimension 244 may have a length of from about 50 mm to about 150 mm, or from about 70 mm to about 125 mm, or from about 75 mm to about 100 mm.

The major and minor dimensions may have the same measurement (i.e., the ratio is 1:1), but if they are different, then major dimension is the larger measurement. Typically, the major dimension 242 is measured from one side wall to the opposite side wall. Typically the minor dimension 244 is measured from the front wall to the back wall. The major dimension 242 may be about 175 mm, and the minor dimension 244 may be about 85 mm.

The ratio of the length of the major dimension 242 to the length of the minor dimension 244 of the body opening 240 may be from 1:1, or from about 1.5:1, or from about 2:1, to about 4:1, or to about 3:1, or to about 2:1; the ratio may be about 2:1. When the ratio is one or is close to one, the opening 240 may be close to the shape of a square or a circle and may provide an opening 240 with a large area that makes filling the body 200 with contents relatively easy. When the ratio is greater than one, then the body 200 may be wider than it is deep, meaning that the container system 100 may have a relatively large surface area on at least one wall, e.g., the front wall 224, which can provide a large shelf impression while taking up relatively little space from front to back.

The body 200 may comprise at least one connecting feature 250 that engages with a complimentary connecting structure 330 on the frame 300 and/or lid 104 in order to secure the frame 300 or lid 104 to the body 200. The connecting feature 250 may be on or near the neck 230 of the body 200.

The connecting feature 250 may selected from a rib, a bead, a thread, a tab, a slot, or combinations thereof. The connecting feature may be a slot 252, which may be configured to receive a tab 332 located on the frame 300 or lid 104. The body 200 may comprise a plurality of connecting features 250. The plurality may include connecting features 250 having different sizes. For example, the plurality of connecting features 250 may include a plurality of slots 252, 253. The plurality of slots may include at least one major slot 252 and at least one minor slot 253, where the major slot 252 is larger than the at least one minor slot 253.

The body 200 may comprise a plurality of major slots 252, such as at least two, at least three, or at least four major slots 252. The major slots 252 may substantially be located at corners of the body 200.

The body 200 may comprise a plurality of minor slots 253, such as least two, at least three, at least four, at least five, at least six, at least seven, or at least eight, or at least nine minor slots 253.

The body 200 may comprise four major slots 252, and seven, or eight, or nine minor slots 253. The portion of the rim 232 adjacent the rear wall 225 may comprise more slots than the portion of the rim 232 adjacent the front wall 224. Typically, the frame 300 or lid 104 will be attached more securely to the body 200 as the number of slots 252, 253 increases.

The body 200 may be connected to the frame 300 and/or lid 104 via other means, which may not include a connecting feature 250, or which may be used on combination with a connecting feature 250. For example, the body 200 may be connected to the frame 300 and/or lid 104 by welding, for example ultrasonic welding, or by an adhesive.

The body 200 may include support walls 260 or buttresses which can help to add support to the body 200. The support walls 260 may extend inwards from the walls into the storage volume 210 and may be joined to the bottom wall 220.

The container systems 100 of the present disclosure may include a frame 300. Depending on the configuration of the container system 100, the frame 300 may be part of the container 102, for example by being connected to the body 200, or the frame 300 may be part of a closure system 110. A frame 300, or even a plurality of frames 300 having different sizes or shapes, can enable the manufacturer to use a single lid 104 with a variety of containers, which may have differently sized and/or different shaped body openings 210.

The frame 300 may include a top wall 317 having an outer surface 318 that faces away from the opening 210 of the body 200 when the frame 300 is connected to the body 200.

Figure 6:
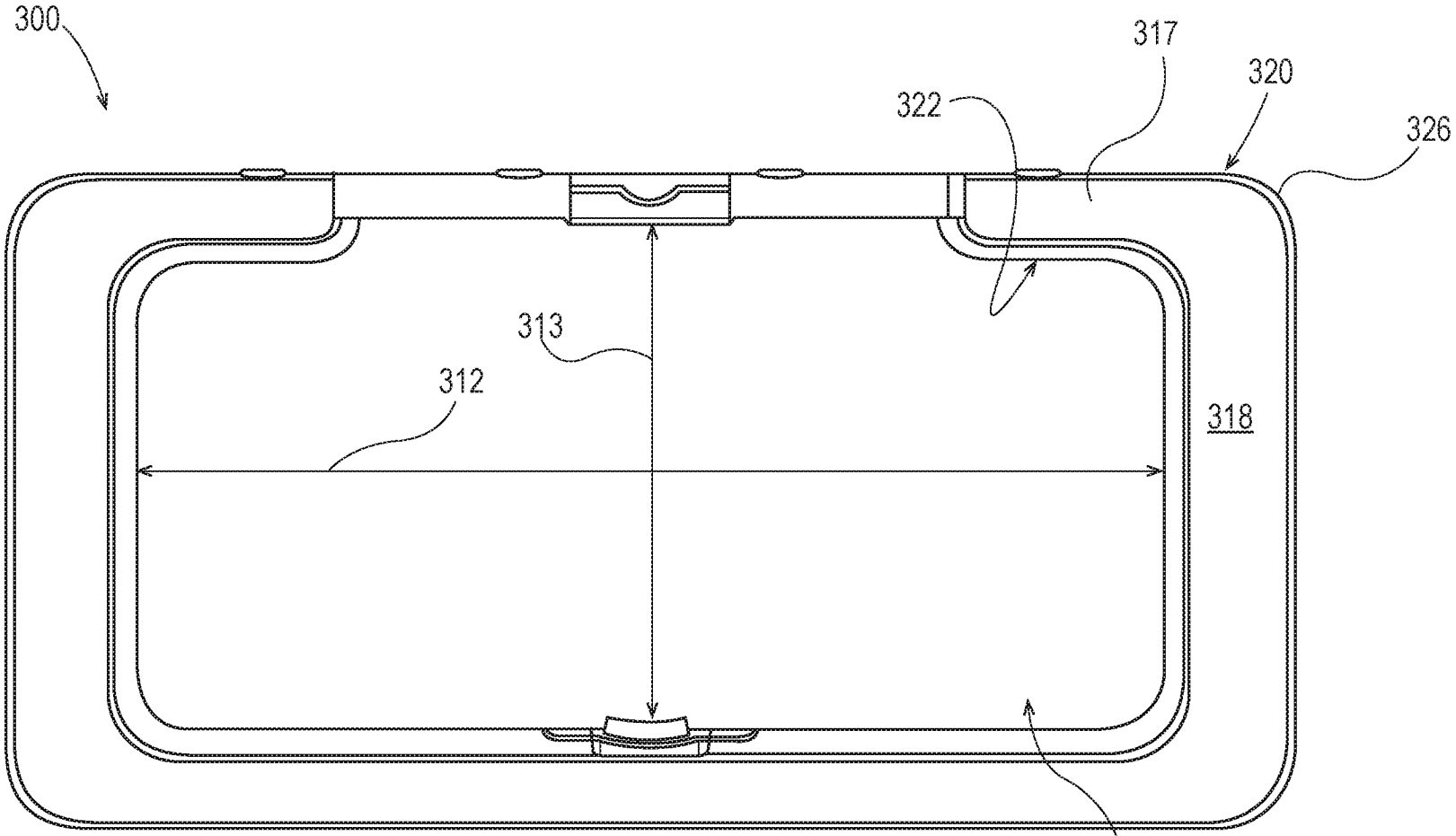
FIG. 6 shows a top view of a frame according to the present disclosure.

As shown in FIG. 6, the frame 300 may have an outer periphery 320. The top wall 317 may have an outer edge 326 at the outer periphery 320. The outer edge 326 may include a shoulder that transitions into a skirt that extends axially downward.

The frame 300 may have an inner periphery 322. The inner periphery 322 may define an opening 310. The opening 310 may have a major dimension 312 and a minor dimension 313. The major dimension 312 may have a length of from 75 mm, or from about 100 mm, or from about 125 mm, to about 250 mm, or to about 200 mm, or to about 200 mm, or to about 175, or to about 150 mm. The minor dimension 313 may have a length of from about 50 mm, or from about 60 mm to about 150, or to about 100, or to about 75 mm. The major dimension 312 of the opening 310 of the frame 300 may be substantially parallel to the major dimension 242 of the opening of the body 200 when the frame 300 is connected to the body 200. The minor dimension 313 of the opening 310 of the frame 300 may be substantially parallel to the minor dimension 244 of the opening of the body 200 when the frame 300 is connected to the body 200.

The body's opening 240 may be relatively larger than the frame's opening 310. Having a relatively large opening 240 in the body 200 can make it easier to provide the storage volume 210 with materials, such as unitized dose articles 600. However, it may be difficult to provide a a lid 104 large enough to fit such an opening 240, and/or to provide enough biasing force on such a large lid 104 so that the lid 104 opens automatically (e.g., "pop-up" or "auto-lift" functionality) once the lid 104 is disengaged from the body 200 or frame 300. Therefore, it may be desirable for the frame 300 to have a relatively smaller opening 310 so that the corresponding lid 104 may be relatively smaller as well. The major dimension 312 of the frame's opening 310 may be less than the major dimension 242 of the body's opening 240. The minor dimension 313 of the frame's opening 310 may be less than the minor dimension 244 of the body's opening 240.

Figure 7:
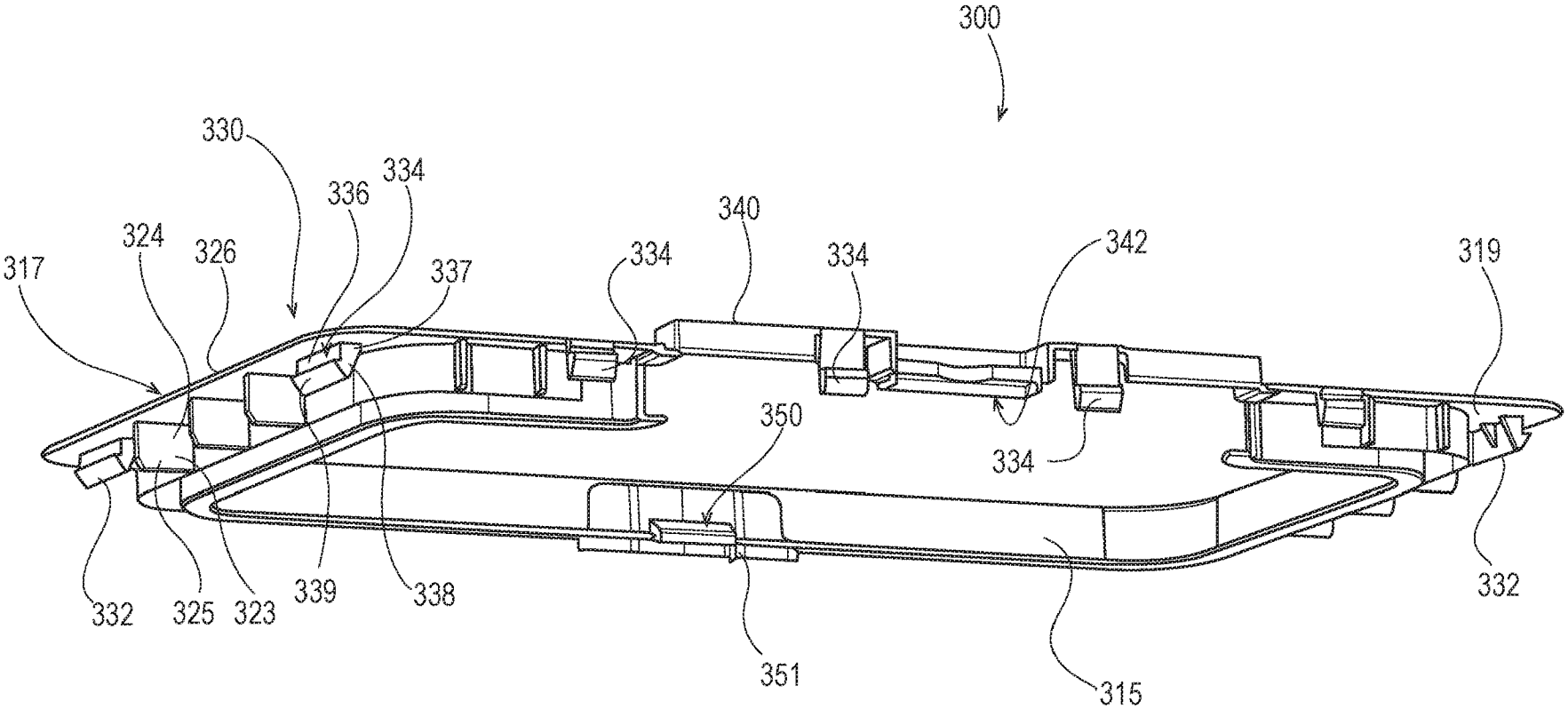
FIG. 7 shows a bottom perspective view of a frame according to the present disclosure.

As shown in FIG. 7, the frame 300 may include connecting structures 330. The connecting structures 330 may be configured to engage with a complimentary connecting feature 250 on the body 200 in order to secure the frame 300 to the body 200. The connecting structures 330 may be located at or near the outer periphery 320 of the frame 300. The connecting structures 330 may extend substantially axially downward towards the body 200.

The connecting structures 330 may be of any suitable configuration. The connecting structures 330 may be configured to be connectable to, for example receivable by, the connecting features 250 of the body 200. At least some or all of the connecting structures 330 may be in the form of a tab 332, 334. The tab 332, 334 may be sized and configured to be receivable by a slot 252, 253 of the body 200. The tab 332, 334 may be made of a resilient material that can be deflected as it passes through a slot 252, 253 of the body 200 and then return to its original position, thereby locking the tab 332, 334 into place.

The tab 332, 334 may include a support portion 336 and a locking portion 339. The support portion 336 may include a proximal portion 337 that is attached to the frame 300, which may be at a location at or near the outer periphery 320. The support portion 336 may include a distal portion 338 spaced away from the proximal portion 337. The locking portion 339 may be located at or near the distal portion 338 of the tab 332, 334. The locking portion 339 may be sized and configured to engage with the connecting feature 250 of the body 200 to resist removal of the frame 300 from the body. The locking portion 339 may extend in a direction substantially orthogonal to the support portion 336, such as radially inward or radially outward.

The connecting structures 330 may comprise a major tab 332 and a minor tab 334. The major tab 332 may be larger than the minor tab 334. The major tabs 332 may be located at or near corners 314 of the frame 300. It is believed that major tabs 332 at this position provide greater security. The minor tabs 334 may be located away from the major tab 332 and/or away from the corner 314. The number of minor tabs 334 may be greater than the number of major tabs 332. The frame 300 may comprise at least two, at least three, or at least four major tabs 332. The frame 300 may comprise at least two, at least four, at least six, or at least eight minor tabs 334. It is believed that more tabs 332, 334 provide more security.

The frame 300 may contain a skirt 315 that depends downwardly from a top wall 317, for example from an inner surface 319 of the top wall 317, towards the storage volume 210 of the body 200 when the frame 300 is connected to the body 200. The skirt 315 may be at or near the opening 310 of the frame 300. The skirt 315 may be continuous around the opening 310 or discontinuous. The skirt 315 may be located radially inward from the connecting structures 330 of the frame 300.

The frame 300 may comprise support webs 323. The support webs 323 may add structural support to the frame 300. Support webs 323 may extend radially outward from the skirt 315. The support webs 323 may be adjacent the top wall 318 of the frame 300. The support webs 323 may have a proximal end 324 near the top wall 317, for example an inner surface 319 and a distal end 325 away from the top wall 318. The support webs 323 may taper, for example from a proximal end 324 to a distal end 325 of the web 323. Such tapering may facilitate alignment between the frame 300 and the body 200 when they are being connected.

The frame 300 may comprise a hinge portion 340. The hinge portion 340 may connect to a hinge portion 510 of the lid 104, for example on a second portion 500 or cover of the lid 104. The hinge portion 340 may have any suitable configuration. For example, it may be a living hinge, or it may include a pin. Rather than being hingeably connected, the frame 300 and lid 104 may be slidably connected, allowing the lid 104 to be slid in order to access the storage volume 210.

The frame 300 may comprise a port 342 for the biasing means 130. The port 342 may be sized and configured to receive the biasing means 130. The port 342 may be located on top wall 317, for example the outer surface 318 or the inner surface 319. The port 342 may be inset into the frame 300 so that the biasing means 130 is substantially coplanar with the outer surface 318 and/or inner surface 319 of the frame.

The frame 300 may include a second engagement member 350 that is configured to engage, e.g., receive, a first engagement member 450 of a lid 104. Typically, when the first and second engagement members 450, 350 are engaged, the lid 300 cannot be moved to an open position. The second engagement member 350 may be located at or near the opening 310 of the frame 300. The second engagement member 350 may be located on the skirt 315, for example on an inner surface 316 of the skirt 315 that faces radially inward. The second engagement member 350 may have at least one stop wall 351 that limits the relative motion the first engagement member 450 (e.g., from disengaging or rotating) until the lid 104 or frame 400 is appropriately manipulated. The second engagement member 350 may be a catch that receives a latch.

When the frame 300 is connected to the body 200, the outer edge 326 of the top wall 317 of the frame 300 may nest inside the neck 230 of the container body 200. In such a position, the outer edge 326 is not immediately accessible from outside the container system 100. This configuration can be particularly advantageous for container systems 100 where additional security is desired; due to the nesting, the frame 300 and/or lid 104 cannot be easily pried off, either by prying fingers or by accidental contact during manufacture or shipping with other containers or equipment.

Figure 8:
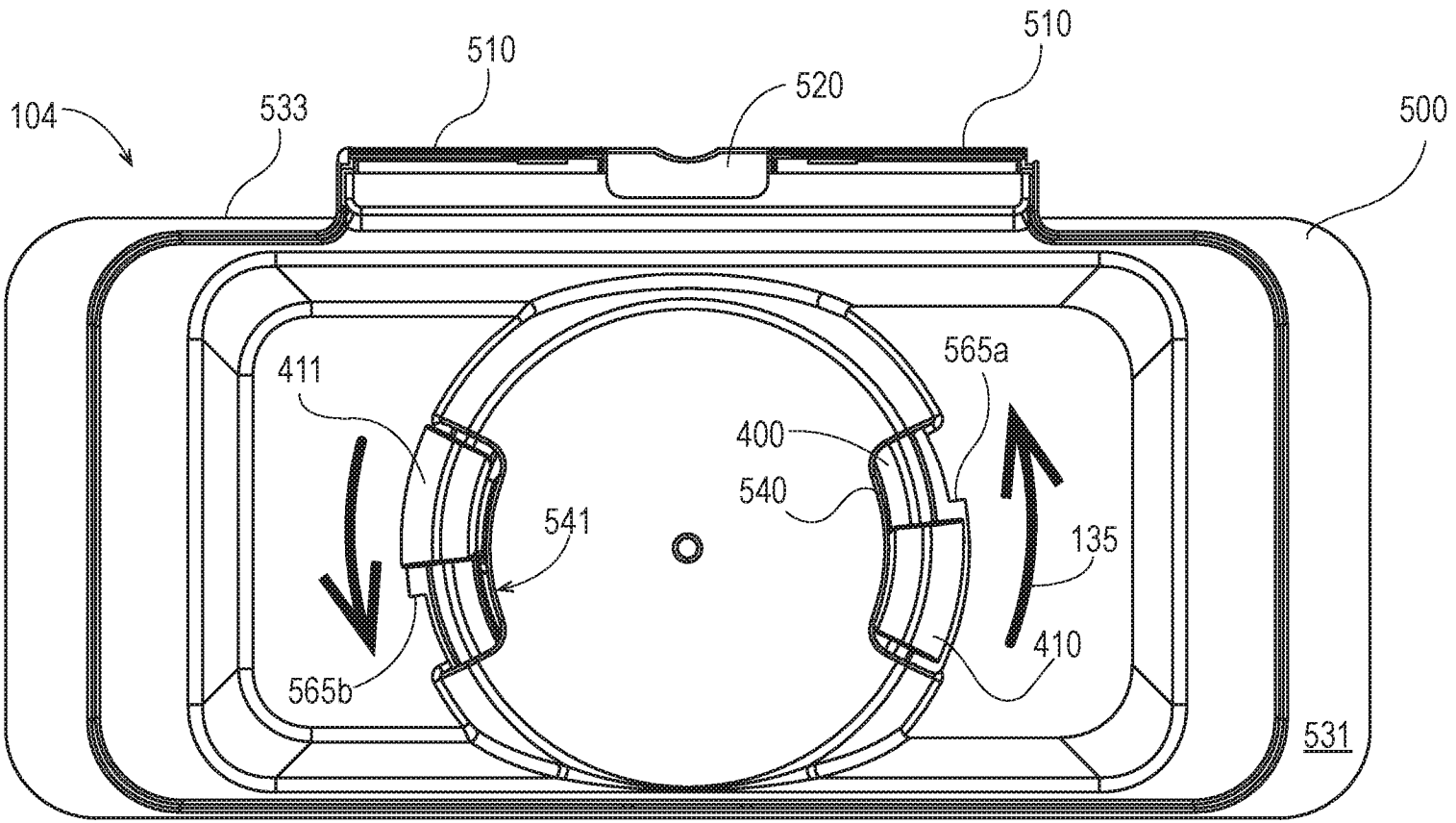
FIG. 8 shows a top view of a lid according to the present disclosure.

As shown in FIG. 8, the container systems of the present disclosure 100 may include a lid 104. The lid 104 may be hingedly connectable to the frame 300 or to the body 200. The lid 104 may be positionable relative to the container 102 to have a closed position in which the lid 104 covers the opening 310, thereby blocking access to the storage volume 210, and an open position in which the lid 104 does not cover the opening 310, thereby allowing access to the storage volume 210.

The lid 104 may include a first portion 400 and a second portion 500. The first portion 500 may be non-integrally connected to the second portion. The first portion 400 may be moveable relative to the second portion 500. The first portion 400 may be moveable from a first position to a second position. Moving the first portion 400 from the first position to a second position may allow the lid 104 to be moved from the closed position to the open position. The second portion 500 may be returnable to the closed position from the open position. The lid 104 may be configured so as to provide a signal, for example an audible signal (e.g., a click), to the consumer that the lid 104 is properly in the closed position.

The second portion may have a top wall 530, which may have an outwardly facing outer surface 531 and an inner surface 532 opposite the outer surface 531. The first portion 400 may substantially face the inner surface 532 of the second portion 500. The top wall 530 may have an outer edge 533.

The lid 104 may comprise at least one hinge portion 510. The hinge portion 510 may be part of the second portion 500 of the lid 104. The hinge portion 510 may connect to a hinge portion 340 of the frame 300. The hinge portion 510 may have any suitable configuration. For example, it may be a living hinge, or it may include a pin.

The lid 104, for example the second portion 500, may comprise a port 520 for the biasing means 130. The port 520 may be sized and configured to receive the biasing means 130. The port 520 may be located on a top wall 530 of the lid 104 or second portion 500, for example the outer surface 531 or the inner surface 532. The port 520 may be inset into the lid 104 so that the biasing means is substantially coplanar with the outer surface 531 and/or inner surface 532 of the second portion 500.

The lid 104 may comprise indicia 135. The indicia 135 may be located on the second portion 500, for example the top wall 530, including the outer surface 531 of the top wall 530. It may be desirable to have indicia 135 on the inner surface 532 of the top wall 530 to provide communication with the consumer when the lid 104 is in an open position, for example regarding usage and/or safety, which may include a reminder or instructions to re-close the lid 104. The indicia 135 may be molded integrally with, printed on, and/or affixed (such as by label or sticker) to the lid 104. The indicia 135 may comprise text, a graphic, or a combination thereof. The indicia 135 may indicate a safety indication, an instructional indication, a trademark or brand name, or combinations thereof. An instructional indication may indicate how to open the container system 100, for example with arrows indicating the direction to depress the push pads 410, 411 and/or arrows showing the direction of rotation required to open the container system 100. Any part of the container system 100, including the body 200, the frame 300, the lid 104, the first portion 400, and/or the second portion 500, may include any of the indicia 135 described above.

Figure 9:
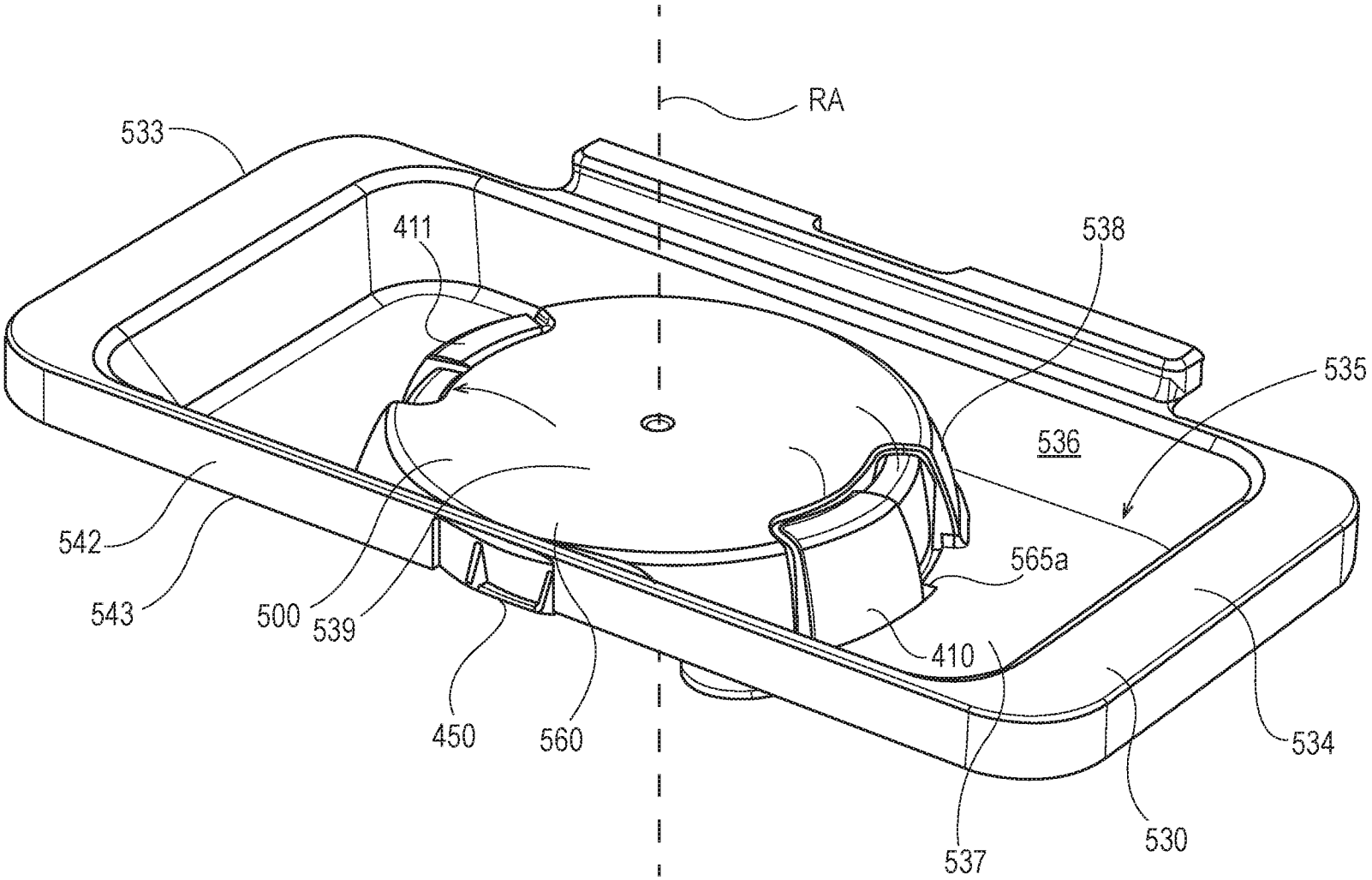
FIG. 9 shows a perspective view of a lid according to the present disclosure.
Figure 10:
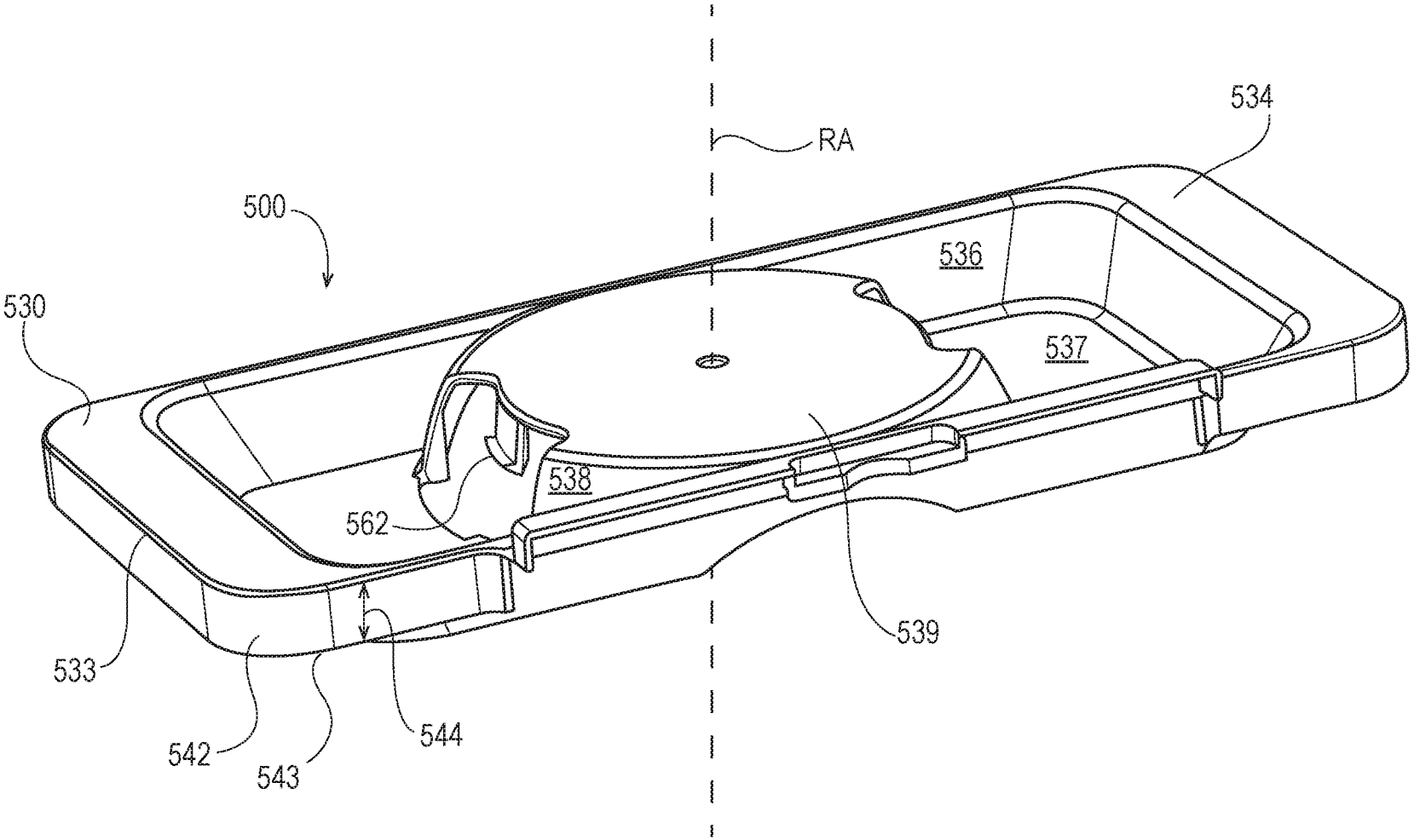
FIG. 10 shows a rear top perspective view of a second portion of a lid (e.g., a cover) according to the present disclosure.

As shown in FIGS. 8-10, the second portion 500 may include at least one aperture 540, 541. The first portion 400, for example a push pad 410, 411 may be accessible through the at least one aperture 540, 541.

As shown in FIG. 9, the lid 104 may comprise a first engagement member 450. The first engagement member 450 may be configured to engage a second engagement member 350, which may be located on the frame 300 or body 200. The first engagement member 450 may be located on the first portion 400 or the second portion 500 of the lid 104, typically the first portion 400. Typically, the first engagement member 450 must be moved relative (for example, rotated or moved radially inward) to the second engagement member 350 in order to move the lid 104 to an open position. The first engagement member 450 may be a latch that engages a catch.

As shown in FIGS. 9 and 10, the top wall 530 of the second portion 500 of the lid 104 may include portions at different relative axial elevations. The top wall 530 may include a valley 535. The valley 535 may at least partly divide an outer portion 534 and an inner portion 539 of the top wall 530. The valley 535 may be radially inward to the outer portion 534 and/or radially outward to the inner portion 539. The valley 535 may include a side wall 536 adjacent the outer portion 534, a side wall 538 adjacent the inner portion 539, and a floor 537 disposed between the side walls 536, 538; the floor 537 may be axially positioned closer to the storage volume 210 when the lid 104 is in the closed position compared to the outer and/or inner portions 534, 539. The aperture(s) 540, 541 may be disposed on a side wall 538 and/or the inner portion 539. The outer portion 534 and the inner portion 539 may touch at an intersection region 560, or they may not touch.

The outer portion 534 and the inner portion 539 may be substantially coplanar, which can facilitate stacking, storage, and/or transport of the container systems 100. Disposing the apertures 540, 541 and the push pads 410, 411 in the valley 535 (i.e., substantially below the plane formed by the outer and/or inner portion 534, 539 of the top wall 530) can provide a number of benefits. For example, recessing the opening mechanism can facilitate stacking, storage, and/or transport. The low profile of the opening mechanism can help to protect it from damage during, for example, the lidding process and/or transport. The low profile also provides the manufacturer with a "clean" looking package, particularly when viewed from the front (e.g., as seen by the consumer when the package is on shelf).

The inner portion 539 may rise up from the top wall 530 like a mesa. In such cases, the top wall 530 may comprise an outer portion 534, an inner portion 539, and a side wall 538 having a proximal end near the outer portion 534 and a distal end near the inner portion 539, where the inner portion 539 is axially elevated above the outer portion 534. The outer portion 534 may substantially surround the inner portion 539.

Figure 11:
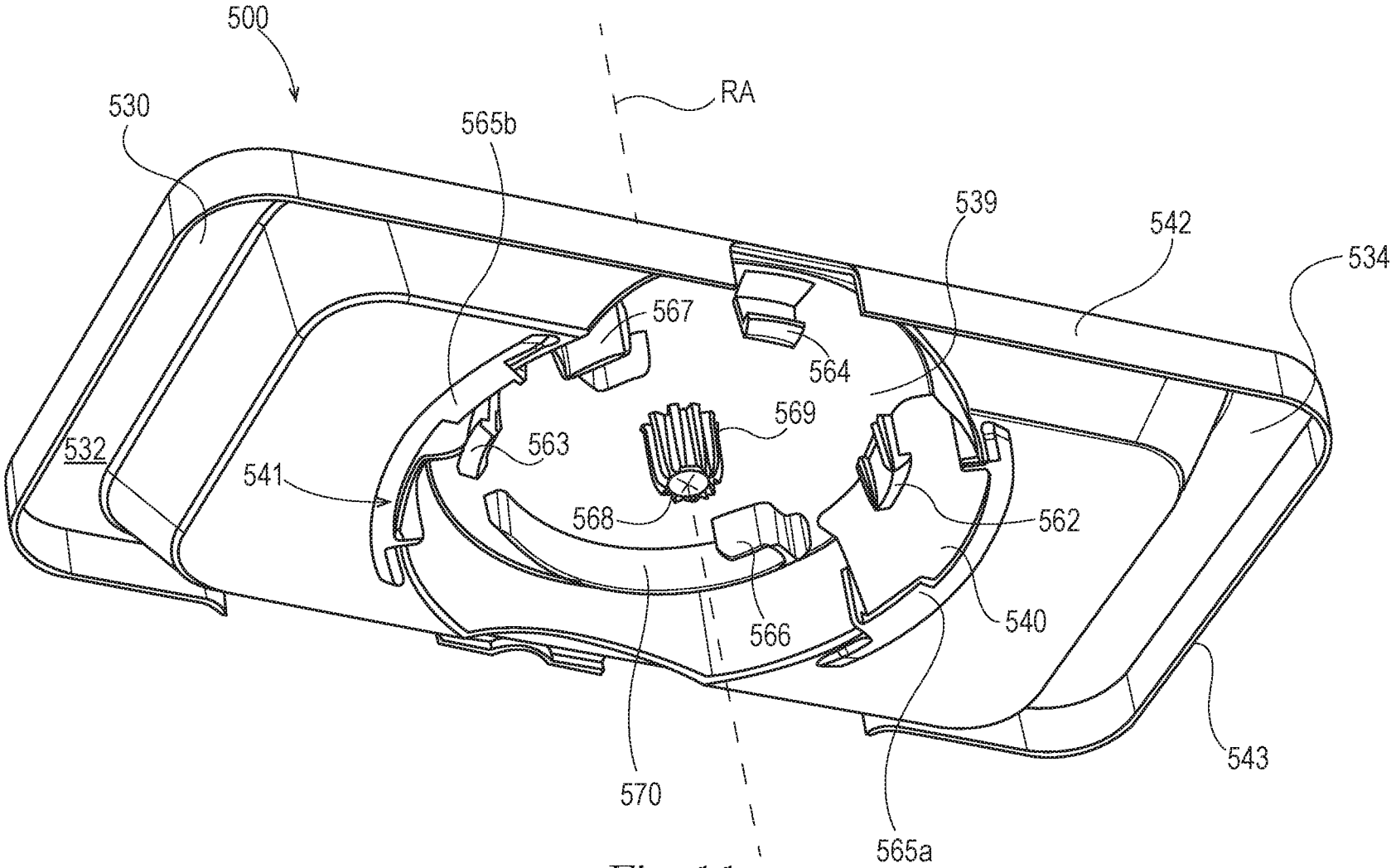
FIG. 11 shows a front bottom perspective view of a second portion of a lid (e.g., a cover) according to the present disclosure.

As shown in FIGS. 10 and 11, the second portion 500 may have at least one connecting portion 562, 563, 564 that facilitates connection of the first portion 400 to the second portion 500. The connecting portion 562, 563, 564 may depend axially downward from an inner surface 532 of the top wall 530. The connecting portion 562, 563, 564 may depend downward from an inner portion 539 of the top wall 530. The connecting portion 562, 563, 564 may be configured to allow rotation of the first portion 400. The connecting portion 562, 563, 564 may be a tab.

As shown in FIG. 11, the second portion 500 may include a post 568 depending from the top wall 530. The post 568 may substantially aligned with a rotation axis (RA). The first portion 400 may be configured to be placed on the post 530 and relatively rotated around it. The post 568 may include ribs 569 or other irregularities, which may facilitate alignment, assembly, and/or rotation. The post 568 and/or ribs 569 may taper from the proximal end near the top wall 530 to the distal end away from the top wall 530.

The second portion 500 may include features that limit the relative motion of the first portion 400. For example, the region of the second portion 500 that defines the aperture 540, 541 may include at least one projection 565*a*, 565*b*. The projections 565*a*, 565*b* may be part of the floor 537 of the valley 535. The projection 565*a*, 565*b* may be configured so that the first portion 400 must be manipulated in one manner (e.g., push pads pressed radially inward) before the first portion 400 may be manipulated in another (e.g., rotated). The projections 565*a*, 565*b* may prevent the first portion 400 from being rotated unless the push pads are pressed radially inward.

The second portion 500 may include at least one rotation stopper 566, 567. The at least one rotation stopper 566, 567 may be a structure that limits the rotation of the first portion 400, typically by being positioned to obstruct further rotation. The rotation stopper 566, 567 may be disposed on an inner surface 532 of the top wall 530, for example on an inner portion 539.

The second portion 500 may include a rear wall 570. The rear wall 570 may depend downwardly from the inner surface 532 of the top wall 530. The rear wall 570 may be configured and positioned to limit the horizontal motion of the first portion 400 relative to the second portion 500. The rear wall 570 may be positioned to be near a part of the first portion 400 that is opposite a first engagement member 450 when the first portion 400 is engaged with the second portion 500. When the lid 104 is designed to be opened upon rotation of the first portion 400, such a position of the rear wall 570 can help to reduce accidental or unintended opening from, for example, dropping the container system or other jarring forces. The rear wall 570 may help alignment of the first portion 400 and the second portion 500 of the lid 104 during assembly. The rear wall 570 may be continuous or discontinuous. The rear wall 570 may be a post or a flange.

The second portion 500 may include at least one push pad stop wall that depends downwardly from the inner surface 532 of the top wall 530. The push pad stop wall of the second portion 500 may be positioned radially inward to a push pad 410, 411 of the first portion 400. The push pad stop wall may limit the radial motion of the push pad 410, 411 to prevent excess wear-and-tear on the push pad 410, 411 and/or accidental disengagement of the first and second portions 400, 500.

The lid 104, for example the second portion 500, may have any suitable shape. The shape is typically complementary to the opening 310 and/or inner periphery 322 of the frame 300. The shape may be substantially rectangular, circular, or generally in the shape of an oval. A circular or oval-type shape of the lid 104 and/or the second portion 500 may be preferred to allow for the frame 300 to have a relatively greater surface area, which may allow for better gripping surfaces during manufacture (for example, by suction cups) and/or for better stacking of the container systems 100 due to a larger, more stable stacking surface. Circular or oval-type shapes may also be preferred to eliminate sharp corners on the lid 104.

The top wall 530 may have a depending skirt 542, as shown in FIGS. 9-11. The skirt 542 may depend downwardly from the top wall 530 towards the storage volume 210 of the container 200 when the lid 104 is in a closed position. The skirt 542 may depend from the top wall 530 at or near the outer edge 533 of the top wall 530. The skirt 542 may terminate in a lower edge 543 that is distal from the top wall 530. The skirt 542 may be continuous or discontinuous around the outer edge 533 of the top wall 530. The skirt 542 may have a depth 544 measured from where the skirt 542 meets the top wall 530 (e.g., at the outer edge 533) to the lower edge 543 of the skirt 542. The skirt's depth 544 may be constant or variable around the periphery of the top wall 530. The skirt 542 may have a depth of from about 1 mm, or from about 2 mm, or from about 5 mm, to about 20 mm, or to about 15 mm, or to about 10 mm. Relatively greater depths 544 may be preferred to minimize the opportunities of the lid 104 being pried open at an unintended time, as a deeper skirt 542 makes it more difficult to get fingers or other levers under the lower edge 543. However, the depth 544 should not be so great that it impedes the opening of the lid 104.

Figure 12:
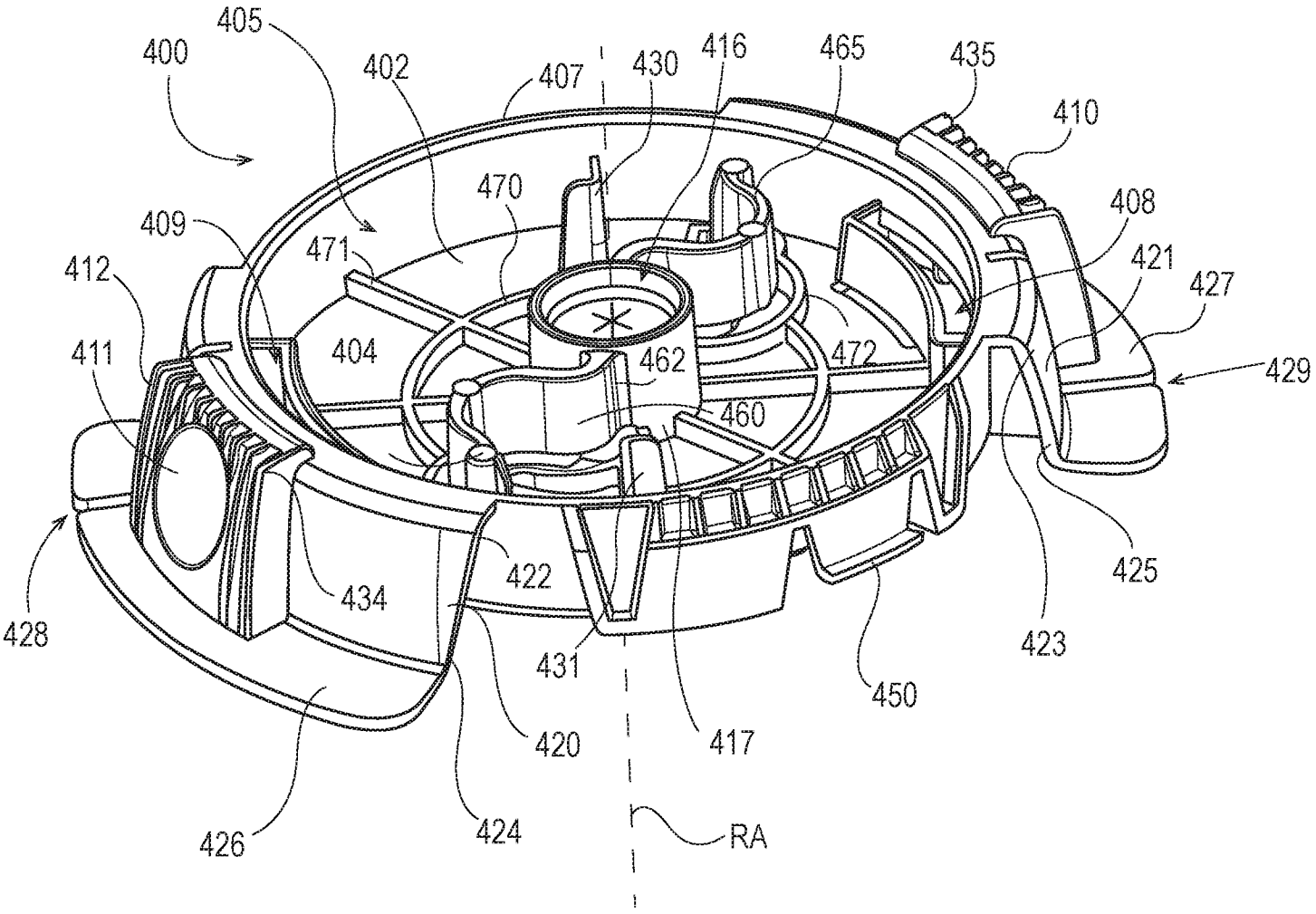
FIG. 12 shows a top perspective view of a first portion of a lid (e.g., a dial) according to the present disclosure.

FIG. 12 shows a top perspective view of a first portion 400 of the lid 104. The first portion 400 may have a base plate 402. The base plate 402 may have an inner surface 404. The inner surface 404 may face the second portion 500, for example the inner surface 532 of the top wall 530, when the first portion 400 is engaged with the second portion 500.

The first portion 400 may have a skirt 406 that depends from the base plate 402. The skirt 406 and the base plate 402 may define an interior region 405 of the first portion 400. The skirt 406 may be continuous or discontinuous around the base plate 402. The skirt 406 may terminate in a rim 407 that is distal from the base plate 402.

The first portion 400 may be rotatable around a rotation axis RA. The first portion 400 may define an aperture 416 that is concentric with the rotation axis RA. The aperture 416 may be configured to receive a post 568 of the second portion 500. The first portion 400 may include a cylinder 417 depending from the base plate 402 that defines the aperture 416; the cylinder 417 may be configured to receive the post 568.

The first portion 400 may include connecting features 408, 409 that are configured to engage with the connecting portions 562, 563 of the second portion 500. For example, the connecting features 408, 409 may be slots configured to receive the connecting portions 562, 563, 564 (e.g., tabs) of the second portion 500. The connecting features 408, 409 may be configured to allow movement (e.g., rotation) of the first portion 400 relative to the second portion 500.

The first portion 400 may include a wall 420, 421 that extends from the skirt 406. The wall 420 may be continuous or discontinuous around the skirt 406. The wall 420, 421 may include a proximal end 422, 423 that is near the skirt 406, for example, near the rim 407 of the skirt 406. The wall may include a distal end 424, 425 this is located away from the skirt 406. The wall 420, 421 may be substantially parallel to the skirt 406 in the axial direction.

The wall 420, 421 may include at least one ledge 426, 427 that extends radially outward from the distal end 424, 425 of the wall 420, 421. The ledge 426, 427 may be useful for obstructing visual contact with the contents of the container, particularly when the push pads 410, 411 are depressed radially inwardly. The ledge 426, 427 may also provide physical obstruction, so that contents do not fall out of the container and/or extraneous material (e.g., moisture, dust, and/or dirt) does not enter the container. Further, the ledge 426, 427 may inhibit the push pads 410, 411 from being moved in an unintended direction (e.g., radially outward).

The at least one ledge 426, 427 may include at least one gap 428, 429. Providing at least one gap 428, 429 in the ledge 426, 427 may improve the flexibility of the first portion 400 and make the push pads 410, 411 easier to depress. It is understood that one of ordinary skill can manipulate the size and/or placement of the gap 428, 429 to provide the desired degree of flexibility. The at least one ledge 426, 427 may not have a gap 428, 429, which may provide improved resiliency of the first portion 400 and/or push pads 410, 411.

The first portion 400 may include at least one push pad 410, or at least two push pads 410, 411. The push pads 410, 411 may be part of the wall 420, 421 that extends from the skirt 406. The push pads 410, 411, when pressed, may be moveable radially inwards towards a rotation axis RA. When there are at least two push pads 410, 411, the push pads 410, 411 may be circumferentially spaced apart from each other around a rotation axis RA; they are typically diametrically opposed (i.e., circumferentially spaced 180°).

The push pad(s) 410, 411, when pressed, may be movable axially, preferably axially downward towards the storage volume 210 when the lid 104 is in a closed position.

The force required to flex the push pad 410, 411 may be adjusted by selecting pad size, hinge placement, stiffening ribs, materials used, intentional areas of weakness (e.g., due to thinned areas, scoring, apertures, gaps, etc.), or other variables evident to one of ordinary skill. The pressing force required to flex the push pads 410, 411 is typically from about 1 pound to about 5 pounds, or from about 1.5 pounds to about 3 pounds.

The push pads 410, 411 may include irregularities 412, such as ribs, bumps, and/or dimples. Such irregularities 412 may provide friction and make the push pads 410, 411 easier to grip when pressing the push pads 410, 411 and/or rotating the first portion 400. The irregularities 412, such as ribs, may highlight or define the preferred location at which force should be applied. The irregularities 412 may be bumps.

The push pads 410, 411 may be a certain distance apart, measured from the radially outward surface 434 of one push pad 410 to the radially outward surface 435 of the other push pad 411. This distance may be selected to fit the functional hand span of an adult human, so that a user may be able to operate the lid 104 with one hand. The push pads 410, 411 may be disposed from 2 cm, or from 3 cm, or from 4 cm, or from 5 cm, to 12 cm, or to 10 cm, or to 8 cm, or to 6 cm apart. The ratio of the distance between the push pads 410, 411 to the major dimension of the opening 310 of the frame 300 and/or the opening 240 of the container body 200 may be from 1:10, or from 1:8, or from 1:6, or from 1:5, to 1:1.5, or to 1:2, or to 1:3, or to 1:4. This ratio may be selected to optimize the size of the opening (preferably relatively large to allow for efficient filling) compared to the hand span required to operate the push pads 410, 411 (preferably relatively small to allow for convenient operation).

The first portion 400 may include a first engagement member 450. As described above, the first engagement member 450 may be configured to engage a second engagement member 350, which may be located on the frame 300 or body 200. The first engagement member 450 may be a latch that engages a catch.

The first portion 400 may include a stop wall 430, 431. The stop wall 430, 431 may depend from the base plate 402, for example into the interior region 405 of the first portion 400. The stop wall 430, 431 may be sized and positioned to engage with the at least one rotation stopper 566, 567 of the second portion 500, thereby limiting the rotation of the first portion 400.

When rotating from the first position to the second position, or vice versa, the first portion 400 rotates relative to the second portion 500 across an angle of from about 1°, or from about 5°, or from about 10°, or from about 15°, to about 180°, or to about 90°, or to about 60°, or to about 45°, or to about 30°, or to about 25°. The degree of rotation should be large enough to allow the lid 104 to disengage from the container 102 while remaining secure when not being actively opened. However, it may be desirable for the degree of rotation relatively small for convenience of use, e.g., so that the consumer can open the container system 100 with one hand without having to reposition his or her hand.

The first portion 400 may include at least one support wall 470, 471, 472. The at least one support wall 470 may depend from the base plate 402. The at least one support wall 470 may be substantially concentric to the aperture 416 and/or the rotation axis RA; the at least one support wall 471 may extend substantially radially from the aperture 416 and/or the rotation axis RA; the at least one support wall 472 may substantially trace the biasing structure 460; or any combination thereof.

The lid 104 may comprise a biasing structure 460. The biasing structure 460 may be configured to return the first portion 400 to the first position after movement to the second position. The first portion 400, the second portion 500, or both may comprise the biasing structure 460. The first portion 400 may comprise the biasing structure 460. The biasing structure 460 may be located in the interior region 405 of the first portion 400. The biasing structure 460 may depend, at least in part, from the base plate 402.

As shown in FIG. 12, the biasing structure 460 may comprise a first end 461, a second end 462, and a middle portion 463 disposed therebetween. The biasing structure 460 may be anchored at a first end 461 to the base plate 402 and anchored at a second end to the cylinder 417; the second end 462 may be anchored to the base plate 402. When force is applied to the biasing structure 460 (e.g., upon rotation from a first position to a second position), the biasing structure 460, for example the middle portion 463 may elastically deform; when the force is released, the biasing structure 460 may cause the first portion 400 to return to the first position.

The biasing structure 460 may be formed integrally with rest of the first portion 400 or the second portion 500; for example, they may be molded as a single piece. The biasing structure 460 may be a separate piece from the first portion 400 and/or the second portion 500.

The biasing structure may comprise at least a first biasing structure 460 and second biasing structure 465. The first and second biasing structures 460, 465 may be circumferentially spaced apart from each other; they may be diametrically opposed.

The biasing structure 460, 465 may comprise a spring system. The spring system may comprise one or more springs, as shown in FIG. 12. The biasing structure 460 may comprise an elastic band, metal spring, a flange, or any other suitable biasing means. The biasing structure 460 may have any suitable shape, including a C-shape, an S-shape, or even a straight flange.

The biasing structures 460, 465 may be located on the first portion 400 (as shown in FIG. 12) and may engage with relatively stationary complimentary structures on the second portion 500. Although not shown, it is recognized that the biasing structures 460, 465 may be located on the second portion 500 and may engage with relatively stationary complimentary structures on the first portion 400.

As an example, FIGS. 13-16 show the relative interactions of the first portion 400, the second portion 500, and the frame 300 under usage conditions, as viewed from a top view.

For reference, FIG. 8 shows a top view of the lid in a closed, relaxed position. The first portion 400 is in the first position, the push pads 410, 411 are not being pressed, and the biasing structures 460, 461 are relaxed. When the push pads 410, 411 are not being pressed, the first portion 400 cannot be rotated relative to the second portion 500 due to the projections 565*a*, 565*b* blocking such rotation. Furthermore, the first engagement member 450 of the first portion 400 is engaged with the second engagement member 350 of the frame 300, so that the lid 104 cannot be moved to an open position.

Figure 13:
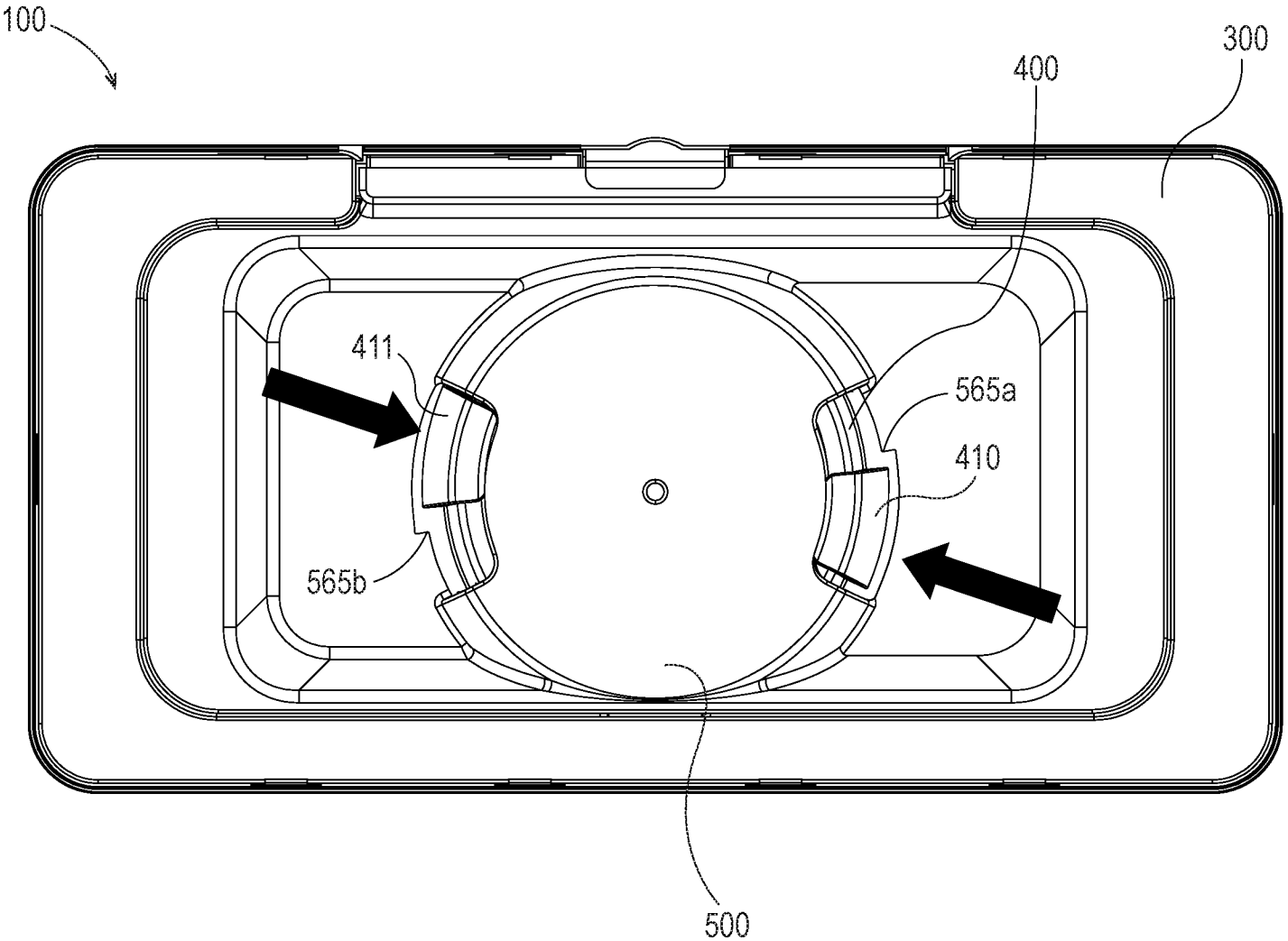
FIG. 13 shows a top view of a container system according to the present disclosure, where the push pads are depressed radially inward.

FIG. 13 shows the system when the push pads 410, 411 are pressed radially inward, as evidenced by the large arrows. The push pads 410, 411 are now clear of the projections 565*a*, 565*b*, so that the first portion 400 can be rotated.

Figure 14:
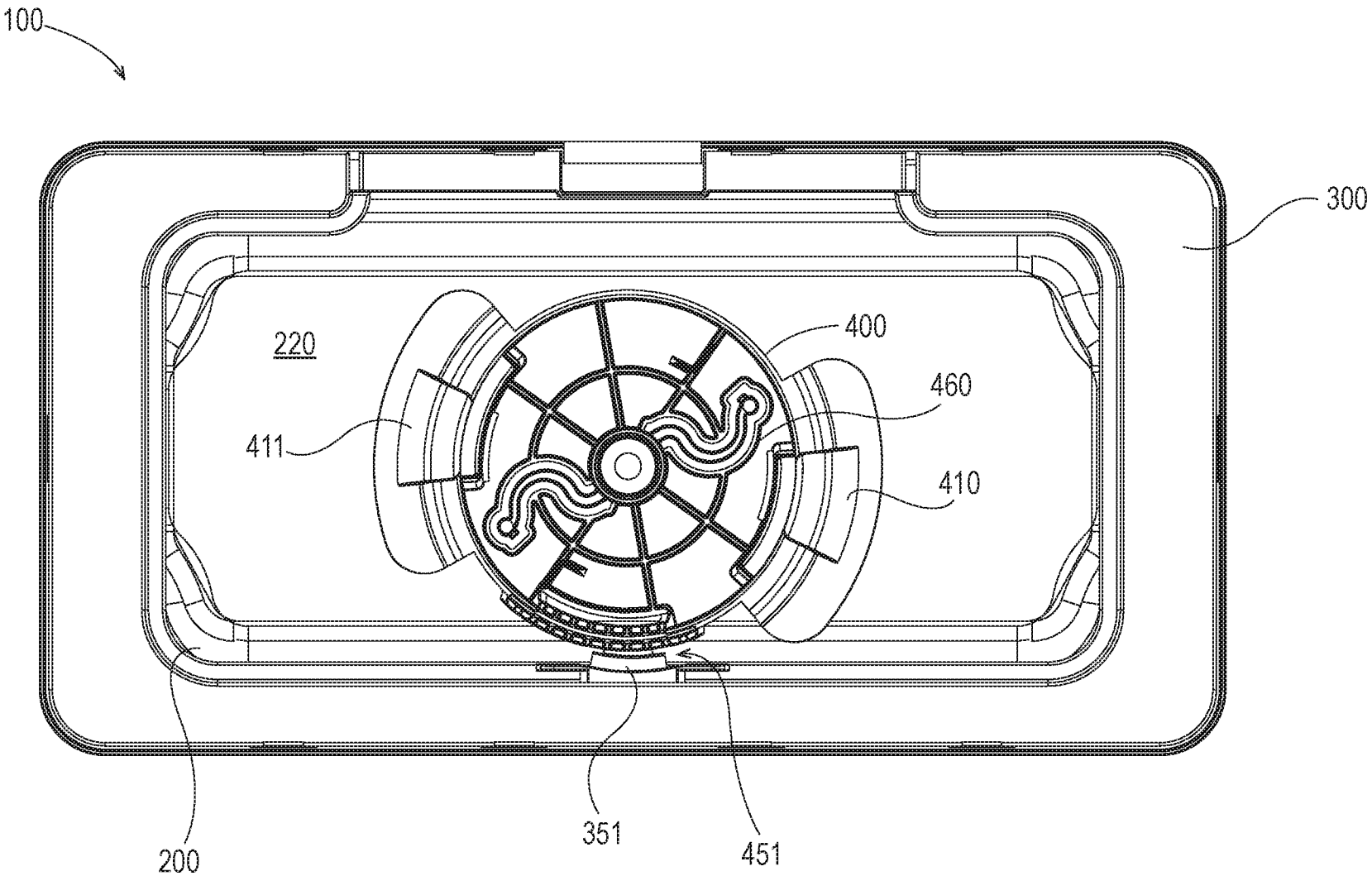
FIG. 14 shows a top view of a container system according to the present disclosure as in FIG. 15, with the second portion (e.g., the cover) of the lid not shown.

FIG. 14 shows the same as FIG. 13, but in this view, the second portion 500 is not shown. The first portion 400 (e.g., a dial) includes a latch 451 that is engaged with a catch 351 on the frame 300. Because this locking mechanism is engaged, the lid cannot be yet opened, even though the push pads 410, 411 are pressed radially inward. Overall, the first portion 400 is in the first position (although the push pads 410, 411 are being pressed), and the biasing structures 460, 461 are in a relaxed, "home" position.

Figure 15:
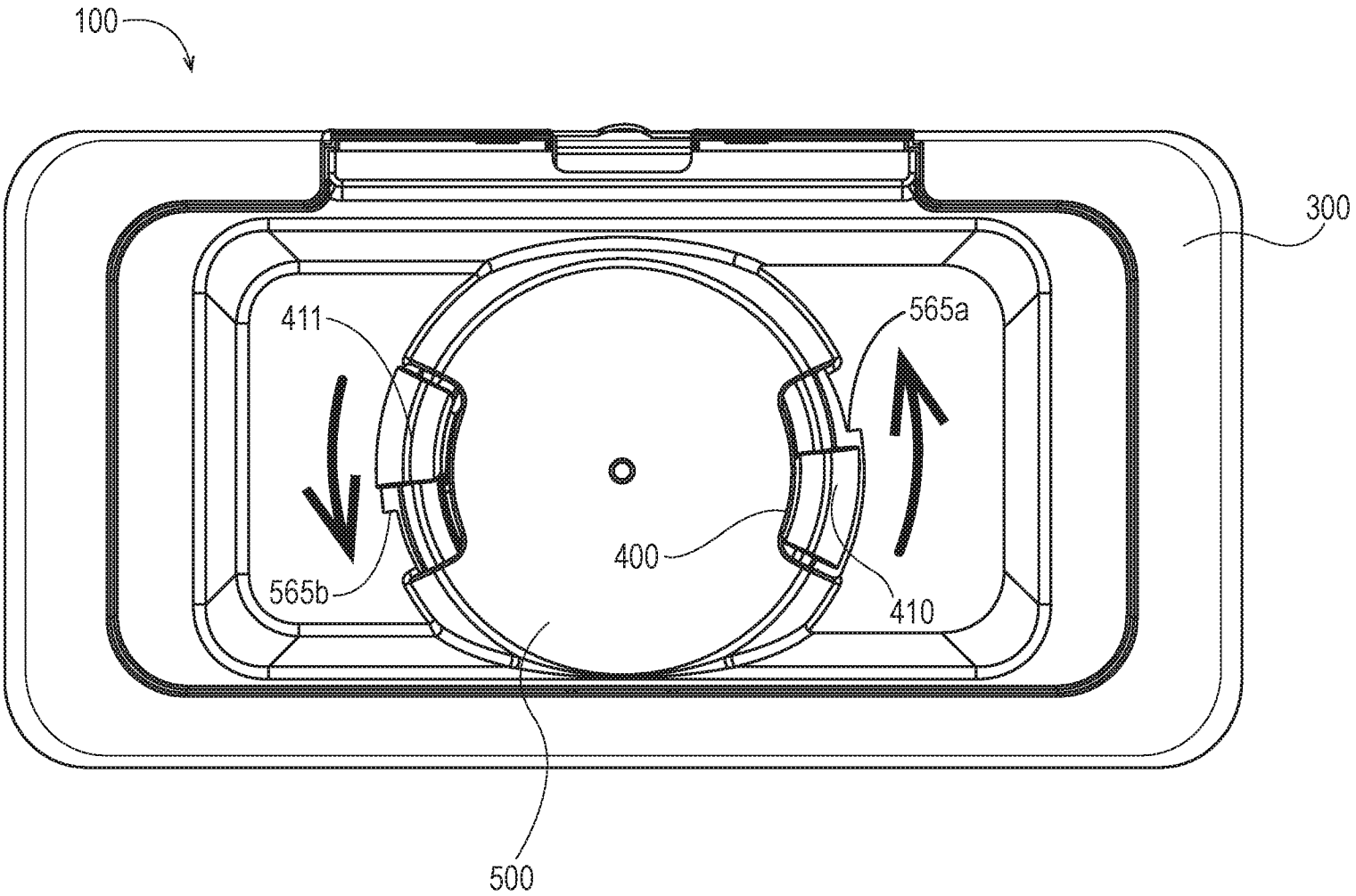
FIG. 15 shows a top view of a container system according to the present disclosure, where the first portion (e.g., the dial) is rotated.

In FIG. 15, the first portion 400 has been rotated approximately 15-25° relative to the second portion 500 to a second position. At least a portion of the push pads 410, 411 have slid past the projections 565*a*, 565*b*.

Figure 16:
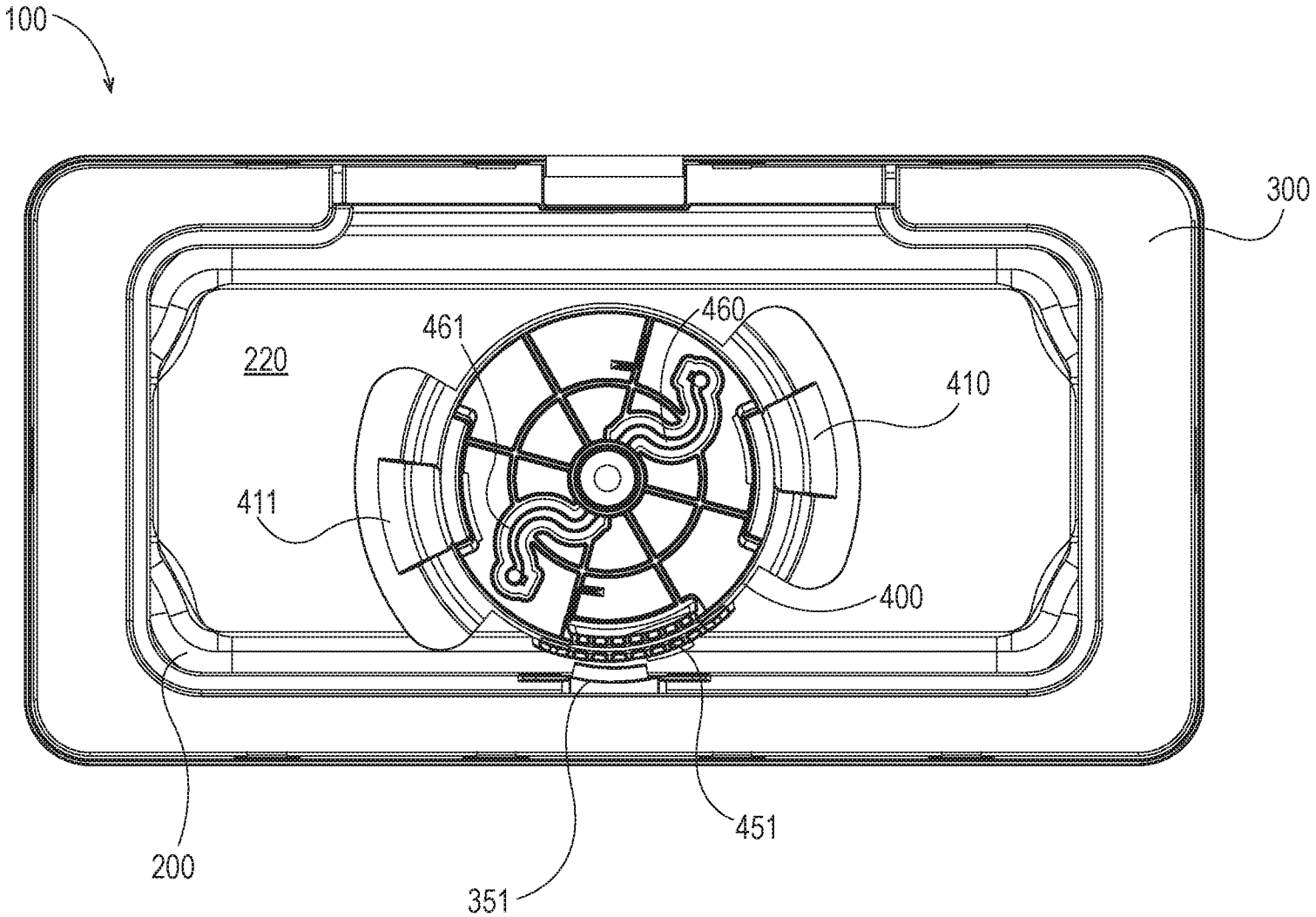
FIG. 16 shows a top view of a container system according to the present disclosure as in FIG. 17, with the second portion (e.g., the cover) of the lid not shown.

FIG. 16 shows the same as FIG. 15, but in this view, the second portion 500 is not shown. The first engagement member 450 is now disengaged with the second engagement member 350 so that the lid 104 can be moved to the open position. The biasing structures 460, 461 are deformed and will return the first portion 400 to the first position when the tension is released.

The container system 100 may contain biasing means 130 that bias the lid 104 to the open position when the first and second engagement members 450, 350 are not engaged. The "auto-lift" or "pop-up" action of the lid 104 is convenient for the consumer. Additionally, the "pop-up" action can alert the consumer to when the lid 104 is not securely in the closed position.

Figure 17:
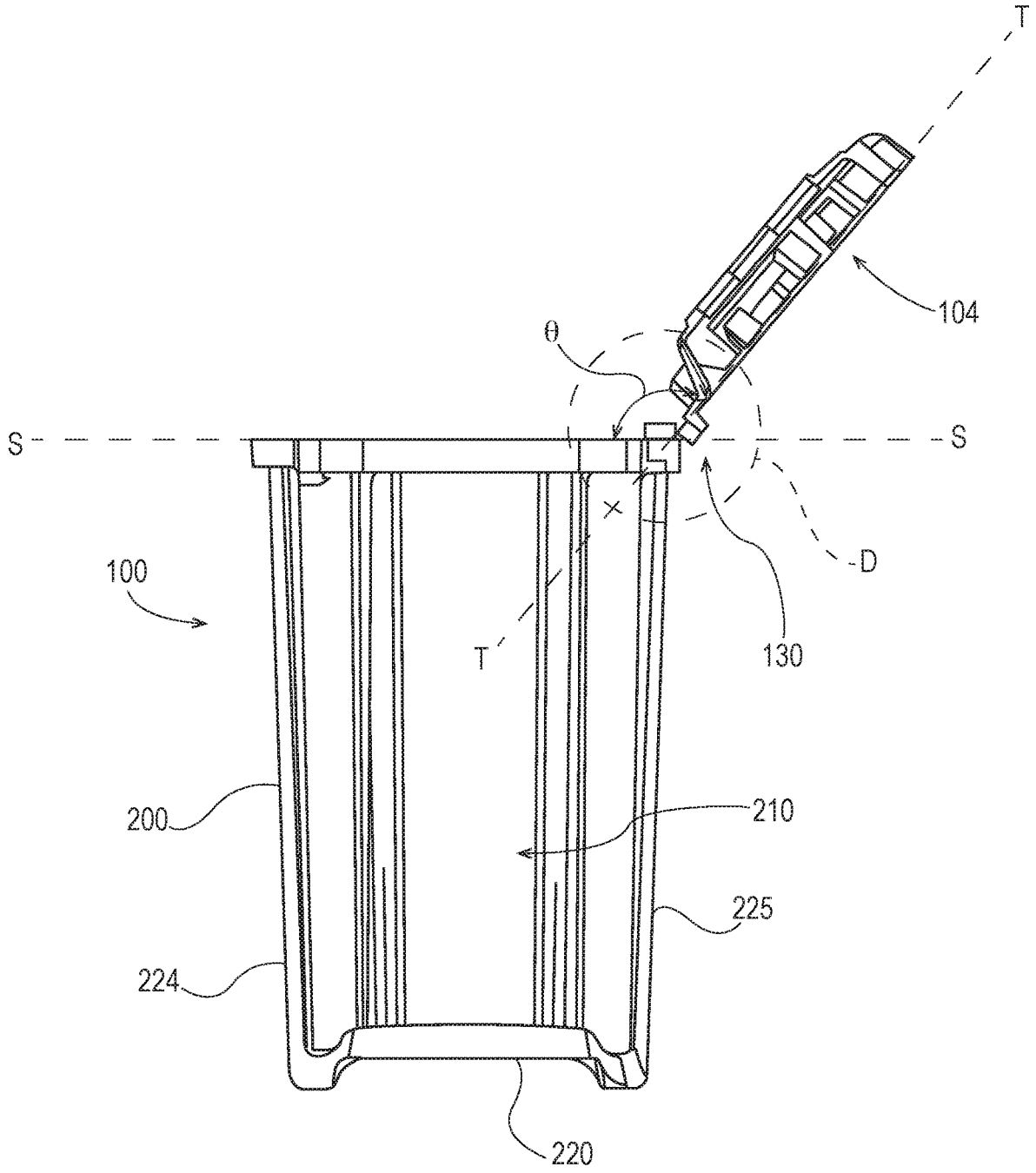
FIG. 17 shows a side cross-sectional view of a container system according to the present disclosure.

The container system 100 may be configured so that the lid 104 stops at a predetermined point when in the open position. FIG. 17 shows a side cross-sectional view of the container system 100 with the lid 104 in an open position. The container system 100 may be configured so that the angle θ formed by the relative positions of the lid 104 in the closed position (roughly indicated by dashed line S-S) compared to the open position (roughly indicated by the dashed line T-T) is from about 90° to about 150°, or from about 110° to about 135°. It may be advantageous for the lid to stop a predetermined angle that is less than 270°, or less than 180° from the closed position. For example, such a predetermined angle may put less wear-and-tear on the hinge system and/or biasing means 130. The predetermined angle may hold the lid 104 at an angle that makes the container relatively inconvenient to store, so that the consumer is encouraged to re-close the lid 104, which can be beneficial for safety and/or product stability reasons. Additionally, the predetermined angle may hold the lid 104 at an angle that provides for convenient viewing of indicia located on the inner surface of the lid when the lid 104 is in an open position; such indicia may include safety reminders, instructions, marketing information, etc., and the lid 104 may comprise such indicia.

The biasing means 130 may be any suitable mechanism for biasing the lid 104 to the open position. The biasing means 130 may be integral to one or more parts of the container system 100. The biasing means 130 may be removable from and/or replaceable to the container system. The biasing means 130 may be selected from a spring, an elastic insert, an elastic band, a resilient flange, or any other suitable means. The biasing means 130 may be made of any suitable material, such as plastic, silicon, metal, or a combination thereof. It may be desirable to select a biasing means 130 and/or a material for the biasing means 130 that shows little to no deformation or warping upon storage and/or repeated use.

The biasing means 130 may be an elastic insert 132. The elastic insert may be made of any suitable elastic material. The elastic insert may be a thermoplastic elastomer. The thermoplastic elastomer may be co-molded with one or more of the parts of the container system 100, for example by bi-injected molding. For example, the thermoplastic elastomer may be formed via co-molding (e.g., bi-injected molding) with the frame 300 and/or the lid 104, typically the frame 300 and the second portion 500. The elastic insert may be a different material than the frame 300 and/or the lid 104.

Figure 18:
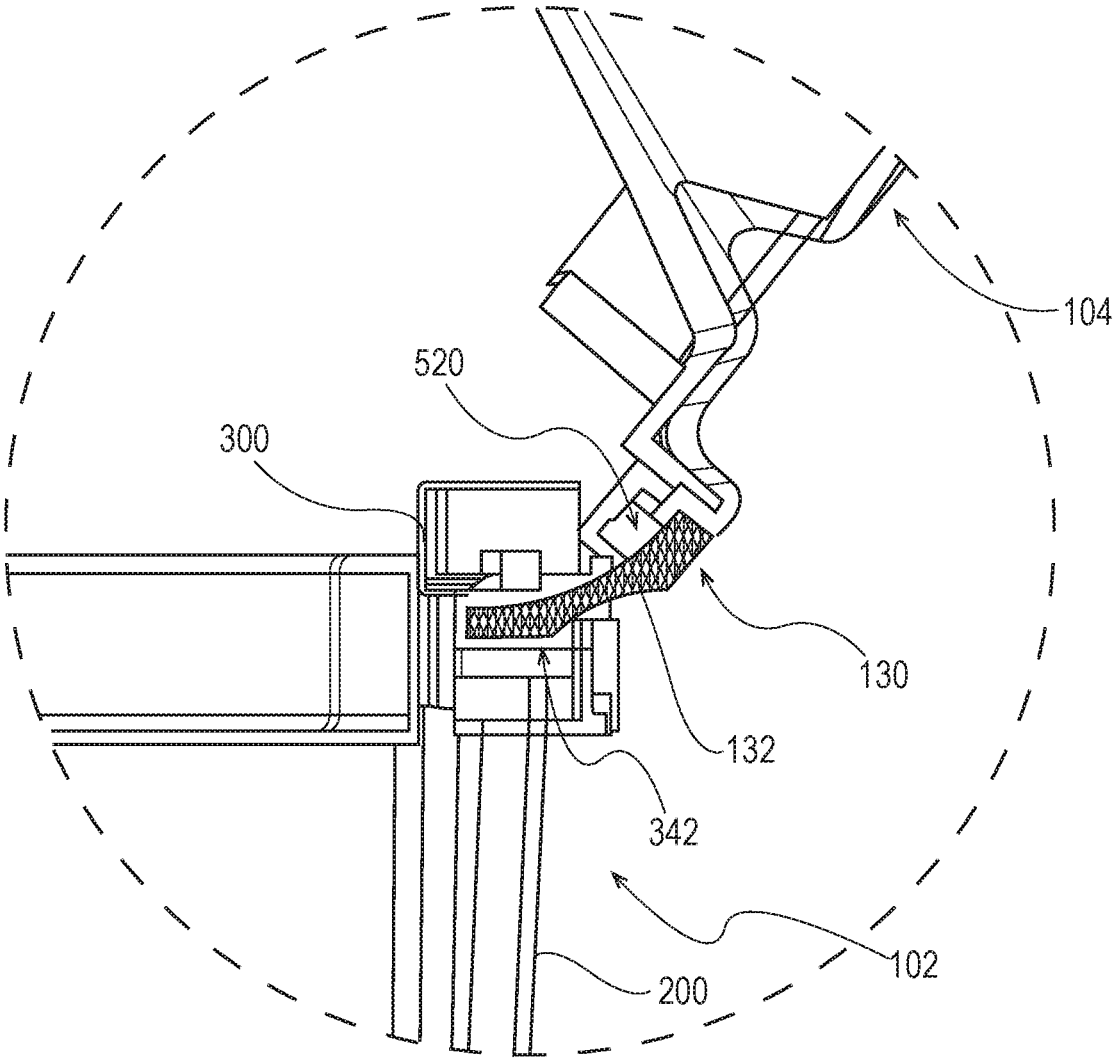
FIG. 18 shows the detail of circle D in FIG. 13.

FIG. 18 shows a close-up view of circle D in FIG. 16. The biasing means 130 may be an elastic insert 132 that is connected to the container 102 and the lid 104. More specifically, the insert 132 may be configured to reside in the ports 342, 520 of the container 102 and lid 104, respectively. When the lid 104 is in the closed position, the insert 132 is bent into a C-shape. When the first and second engagement members 450, 350 are disengaged, the insert 132 lifts the lid 104 to the open position. As described above, the lid 104 may stop at a predetermined open position or angle that is less than 180° from the closed position.

The biasing means 130 may be selected so that the lid 104 does not fully open to the open position at the first opening until the biasing means 130, such as a thermoplastic elastomer insert 132, is activated. In such cases, the lid 104 opens to an intermediate position that is disposed at an angle formed with the closed position that is less than the angle formed at the open position. The angle formed by the intermediate and closed positions may be from about 5° to about 60°, or from about 10° to about 45°. The user, at the first opening, must urge the lid 104 from the intermediate position to its fully open position. After the first opening, the biasing means 130 may be sufficiently activated and may automatically bias the lid 104 to its fully open position upon subsequent openings within a particular time period after the first opening, such as one hour, two hours, three hours, four hours, five hours, or even eight hours. Such a system may be preferred to minimize accidental opening and subsequent leakage or product loss during storage or transport, while still providing the convenience and delight of a "pop-up" lid over the course of multiple uses (e.g., laundry loads) on a particular day.

Figure 19:
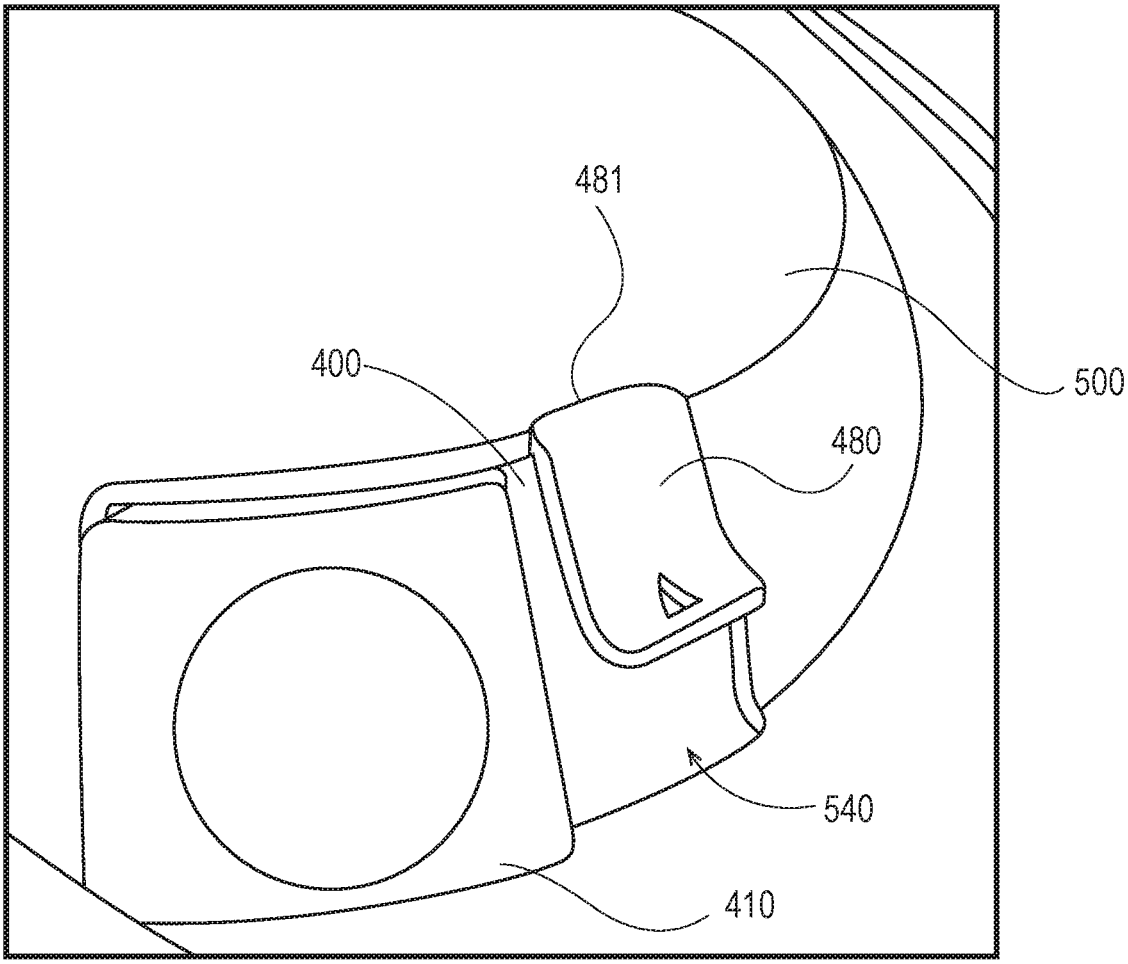
FIG. 19 shows a tamper-evident feature according to the present disclosure.

The container systems 100 of the present disclosure may include a tamper-evident feature 480. As shown in FIG. 19, the tamper-evident feature 480 may be removably attached to the container system 100, for example to the first or second portions 400, 500 of the lid 104. The tamper-evident feature 480 may be attached at a frangible portion, for example at a line of weakness 481. The tamper-evident feature 480 may be attached to the second portion 500 (e.g., the cover) and may be positioned to inhibit rotation of the first portion 400, even when the push pads 410, 411 are pressed, for example by blocking part of the aperture 540, 541. The tamper-evident evident features 480 may be attached to the first portion 400 (e.g., the dial) of the lid 104. The tamper-evident features 480 may include a sticker that connects the lid 104 and the tub 200.

The container systems 100 of the present disclosure may include any of the components of the present disclosure in any suitable arrangement recognizable to one of ordinary skill, including configurations other than those explicitly illustrated here. For example, the first portion 400 (e.g., the dial) may be connected to the frame 300, close to a side wall of the container body 200. Upon moving the first portion 400 from the first position to the second position, the second portion 500 (e.g., the cover) may be able to move from a closed position to an open position, for example hingedly open. The first portion 400 may be connected to the frame 300, though closer to the center of a front wall of the container body 200. The first portion 400 may be connected to the body 200. Such a configuration may be desirable so that both the lid 104 and the front wall of the body may have a smooth, clean look; the dial may be placed on a rear wall of the body 200. One of ordinary skill will recognize that the various connecting and engagement features of the present container systems 100 can be rearranged as necessary to facilitate these or other configurations.

The container system 100 may contain any suitable material or composition. Typical materials and compositions include, but are not limited to, fabric care treatments, hard surface cleaners, soaps, shampoos, conditioning agents, pesticides, paint, solvents, industrial chemicals, industrial hardware (e.g., nails, screws, etc.), medicines, pills, food, and the like. The material may be water-sensitive material, meaning that the material has a tendency to dissolve or degrade when exposed to liquid water or water vapor. The material may be a consumer product, preferably a household care product, preferably a cleaning composition, more preferably a cleaning composition in the form of a unitized dose article.

Non-limiting examples of useful compositions include light duty and heavy duty liquid detergent compositions, hard surface cleaning compositions (such as dish care compositions, including compositions intended for use in an automatic dishwashing machine), detergent gels commonly used for laundry, bleach and laundry additives, shampoos, body washes, and other personal care compositions. Compositions may take the form of a liquid, gel, solid, a unitized dose article, or mixtures thereof. Liquid compositions may comprise a solid. Solids may include powder or agglomerates, such as micro-capsules, beads, noodles or one or more pearlized balls or mixtures thereof. Such a solid element may provide a technical benefit, through the wash or as a pre-treat, delayed or sequential release component; additionally or alternatively, it may provide an aesthetic effect.

In some aspects, the compositions may comprise one or more of the following non-limiting list of ingredients: opacifier; antioxidant; fabric care benefit agent; detersive enzyme; deposition aid; rheology modifier; builder; bleaching agent; bleach precursor; bleach catalyst; chelant; perfume; whitening agent; pearlescent agent; enzyme stabilizing systems; scavenging agents including fixing agents for anionic dyes, complexing agents for anionic surfactants, and mixtures thereof; optical brighteners or fluorescers; soil release polymers; dispersants; suds suppressors; dyes; colorants; hydrotropes such as toluenesulfonates, cumenesulfonates and naphthalenesulfonates; color speckles; colored beads, spheres or extrudates; clay softening agents; corrosion inhibitors and/or anti-tarnish agents; rinse aids. Additionally or alternatively, the compositions may comprise surfactants and/or solvent systems.

The composition may be a flowable composition that can be scooped, such as a free-flowing granular or powdered composition. In such cases, the container system 100 may further comprise a scoop adapted to fit into the container system 100 and to scoop the scoopable composition.

Figure 20:
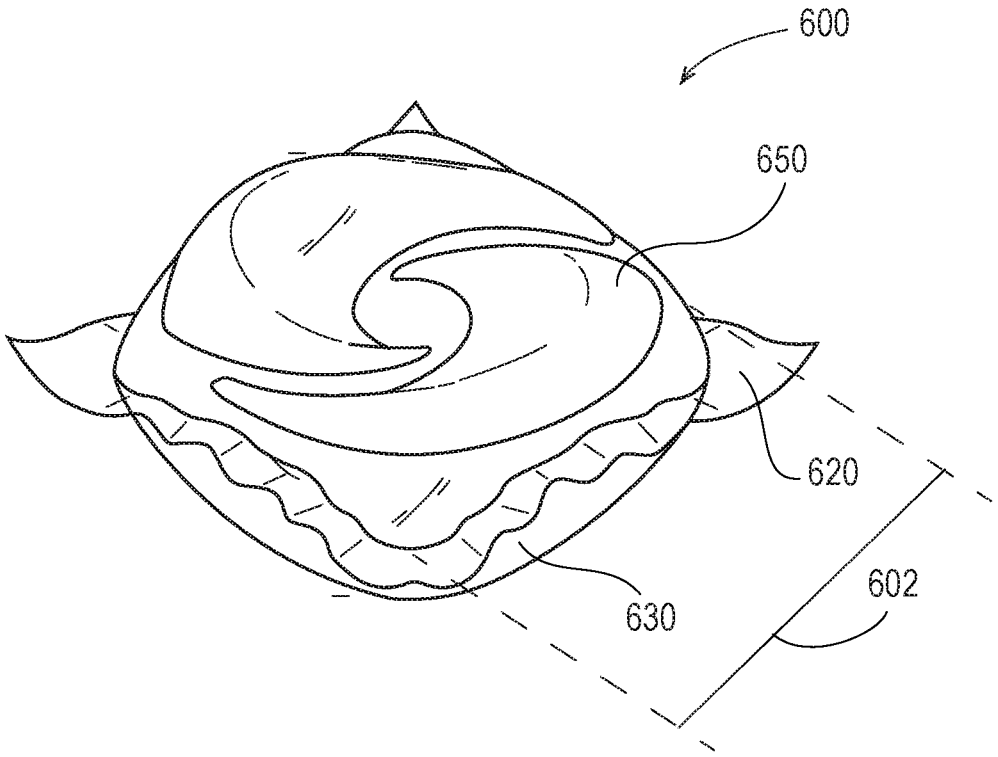
FIG. 20 shows a unitized dose article according to the present disclosure.

The container systems 100 described herein are particularly useful for containing compositions in the form of an article. FIG. 20 shows an example of a unitized dose article 600. The article 600 may be suitable to be grasped by an adult human hand. Such articles 600 may have an article width 602 of from about 10 mm to about 100 mm, or from about 20 mm to about 70 mm, or from about 35 mm to about 55 mm, or from about 40 mm to about 50 mm. If the article 600 is rectangular in shape, the article width 602 is measured as the greatest distance between two parallel sides. When an article 600 has a variable width, the article width 602 is the average of such widths. Such articles 600 may have a height 604, of from about 10 mm to about 100 mm, or from about 15 mm to about 70 mm, or from about 20 mm to about 50 mm, or from about 25 mm to about 35 mm. When an article 600 has a variable height, the article height 604 is measured at the maximum height of the article.

Typically, the container systems 100 described herein are useful for containing articles 600 of unitized doses of a composition (e.g., in counts of 15, 25, 50, 66, 77, etc.), typically of a cleaning composition, more typically of a laundry detergent or hard surface treatment composition. The unitized dose article 600 may be a pouch. The pouch may be formed from a water-soluble film 620, such as a polyvinyl alcohol film, including those available from MonoSol, LLC. The film 620 may encapsulate the composition in a compartment. The pouch may comprise a single compartment, or it or may comprise multiple compartments 630, 640, 650.

The pouch may contain various compositions, which may be of varying colors that may be seen from outside of the pouch. A multi-compartment pouch may contain the same or different compositions in each separate compartment. The compartments may be side-by-side or superposed, for example one or two smaller compartments 640, 650 superposed on one larger compartment 630. This multi-compartment feature may be utilized to keep compositions containing incompatible ingredients (e.g., bleach and enzymes) physically separated or partitioned from each other. It is believed that such partitioning may expand the useful life and/or decrease physical instability of such ingredients.

The compositions of the unitized dose articles 600 typically have low levels of water. In some aspects, the compositions 600 comprise less than about 50%, or less than about 30%, or less than about 20%, or less than about 15%, or less than about 12%, or less than about 10%, or less than about 8%, or less than 5%, or less than 2% water by weight of the composition 600. In some aspects, the composition 600 comprises from about 0.1% to about 20%, or from about 1% to about 12%, or from about 5% to about 10% water by weight of the composition 600.

Closure Systems

Figure 21:
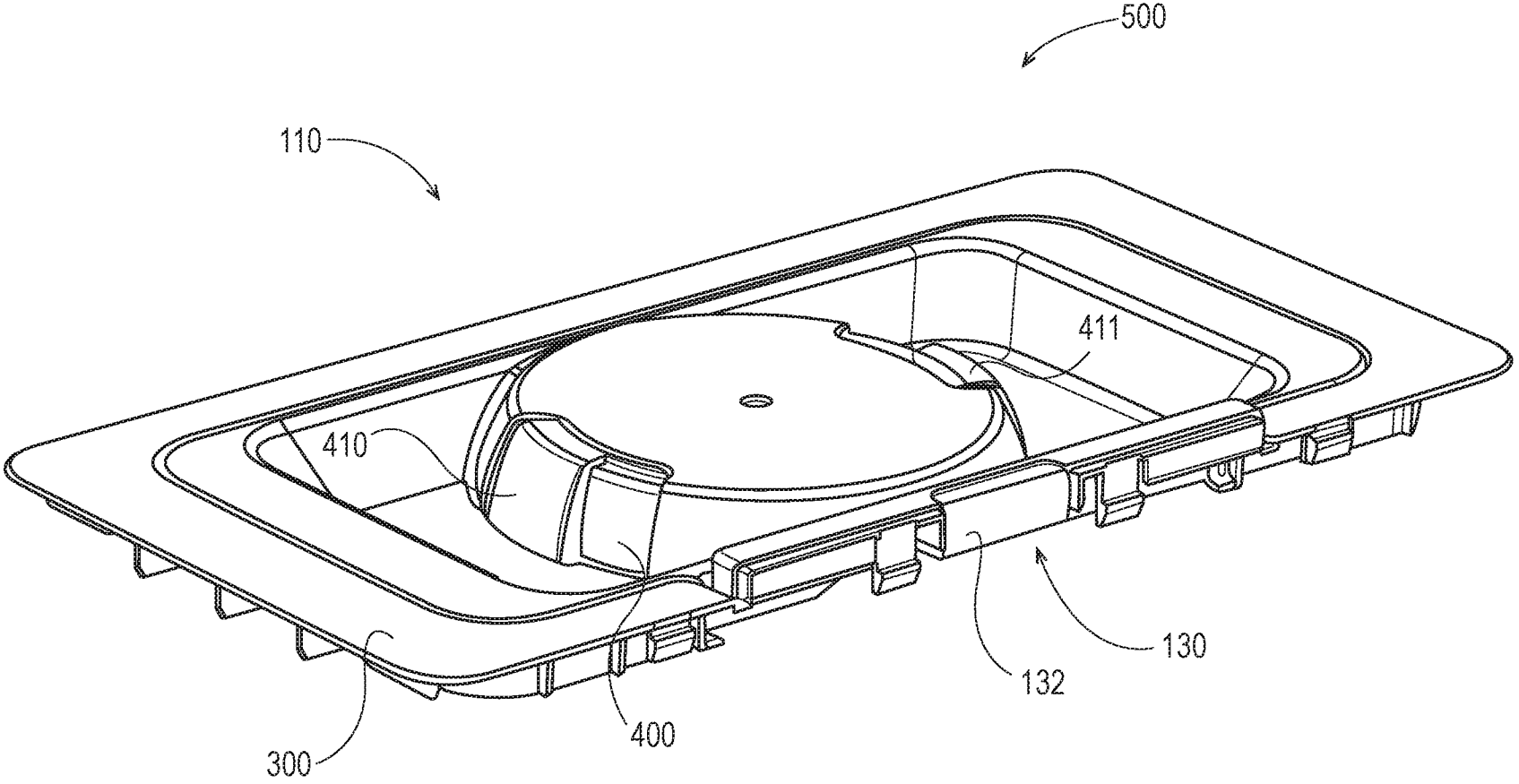
FIG. 21 shows a closure system according to the present disclosure.

The present disclosure relates to closure systems 110. FIG. 21 shows an example of a closure system 110 according to the present disclosure. Use of a closure system 110 according to the present disclosure can allow the manufacturer to separate the manufacture and storage of a container 200 from that of the closure system 110. A manufacturer may also use a closure system 110 according to the present disclosure on several differently sized or shaped containers 200, providing packaging simplification.

The closure system 110 may comprise a lid 104 hingedly connected to a frame 300. The frame 300 may be configured to be connectable to an open end of a container. The lid may comprise a first portion 400 and a second portion 500. The first portion 400 may be in the form of a dial. The second portion 500 may be in the form of a cover. The first portion 400 may be non-integrally connected to the second portion 500. Moving the first portion 400 from a first position to a second position allows the lid 104 to be moved from a closed position to an open position relative to the frame 300.

The frames 300, first portions 400, and second portions 500 described above may be suitable for use in the closure systems 110 according to the present disclosure, and the details provided herein with regard to the container systems 100 generally apply equally to the closure systems 110 of the present disclosure.

The present disclosure also relates to container systems 100 that include closure systems 100. For example, the present disclosure relates to a container system 100 that includes a container 200 with an opening 240 that provides access to a storage volume 210, and a closure system 100. The closure system 110 may include a cover 500 and optionally a frame, the cover 500 being hingedly connected to the container 200 or optional frame 300 and moveable from a closed position that blocks access to the storage volume 210 and an open position that allows access to the storage volume 210. The closure system 110 may also include a dial 400 rotatably connected to the cover 500, the dial 400 having at least one push pad 410, 411. The dial 400 may also include at least one engagement structure 450 removeably engageable with the container 200 or optional frame 300, where the engagement structure 450, when engaged with the container 200 or optional frame 400, prevents the cover 500 from moving from the closed position to the open position. Pressing on the push pad 410, 411 may allow the dial 400 to rotate relative to the cover 500 and thereby disengage the engagement structure 450 with the container 200 or optional frame 300 to allow the cover 500 to be moveable to the open position. The dial 400 may include two push pads 410, 411. The container 200 may container a consumer product, preferably a household care product, preferably a cleaning composition, more preferably a cleaning composition in the form of a unitized dose article 600.

Lid

The present disclosure relates to lids 104. The lids 104 of the present disclosure may include a first portion 400 (e.g., a dial) and a second portion 500 (e.g., a cover) as described above. The lids 104 of the present disclosure may be connectable to frames 300 or container bodies 200 as described above.

Arrays

Figure 22:
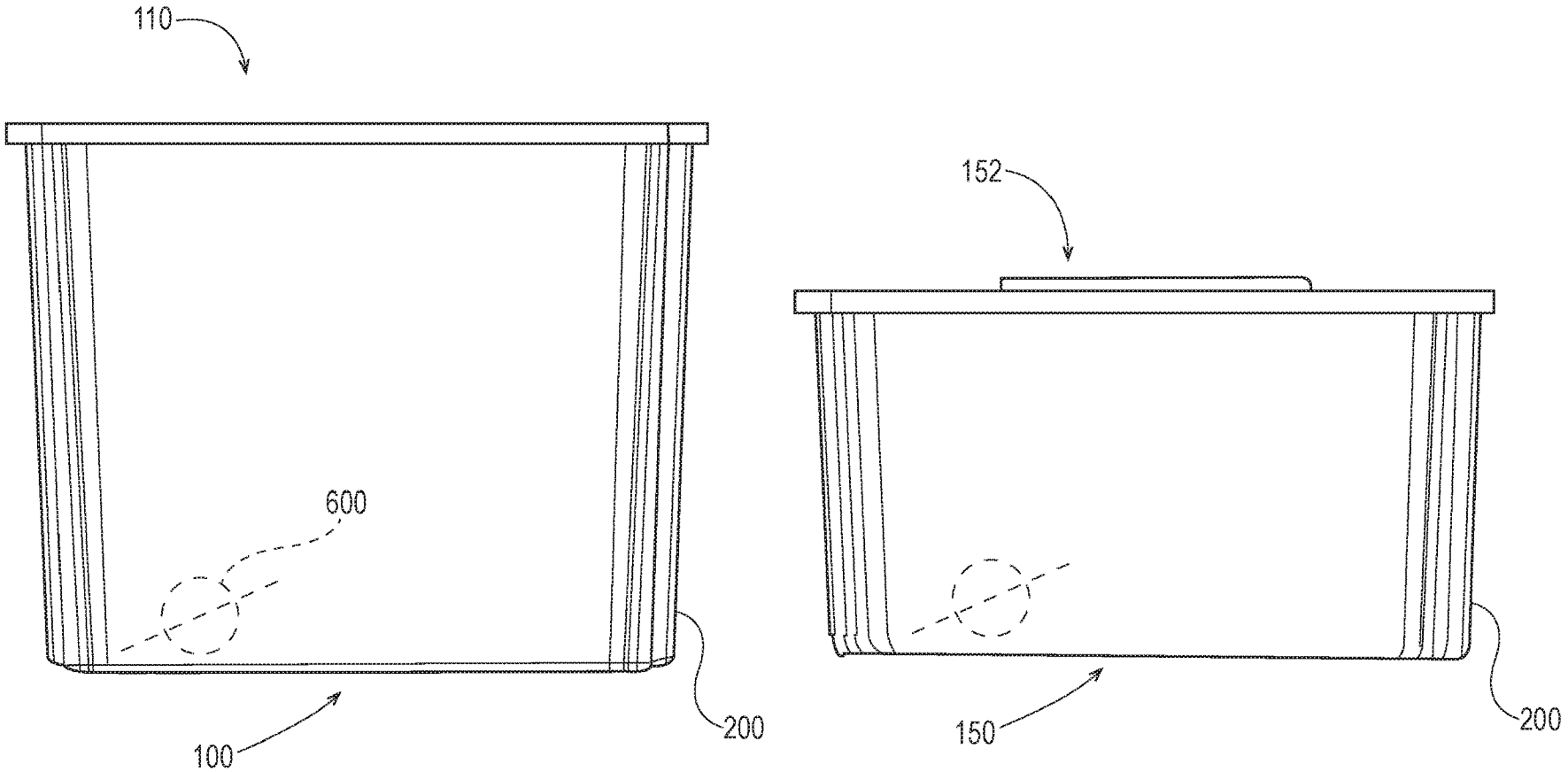
FIG. 22 shows an array of container systems according to the present disclosure.

The present disclosure relates to arrays of container systems. As shown in FIG. 22, the array may include a first container system 100 and a second container system 150, wherein each container system 100, 150 includes a container body 200, 151 and a closure system 110, 152. The closure system 110, which may include a frame and/or lid as described herein, of the first container system 100 may be the same as the closure system 152 of the second container system 150.

The body 200 of the first container system 100 may be of a different size (e.g., by volume) and/or shape compared to the body 151 of the second container system 150. Although the bodies of the first and second container systems 200, 151 may be different in some way, the body openings may be similar or substantially similar, which can facilitate the use of a single type of closure system 110. In other words, the same closure system (e.g., frame and lid) may be used on multiple container bodies that have different characteristics.

The body 200 of the first container system 100 may be the same as the body 151 of the second container system 150. The second container system 150 may be stacked on the first container system 100. The top wall of the lid of the first container system may be sized and configured to receive the bottom wall of the body of the second container system. The bodies may be nested, one in the other, when the closure systems are not attached.

Processes

The present disclosure relates to processes for filling container systems. The process can include the following steps: providing a container body 200, where the body 200 includes a storage volume 210; providing material to the storage volume 210; providing a closure system 110 to the body 200, wherein the closure system includes a lid 104 hingedly connected to a frame 300. The frame 300 may be configured to be connectable to an open end of the container body. The lid may comprise a first portion 400 and a second portion 500. The first portion 400 may be in the form of a dial. The second portion 500 may be in the form of a cover. The first portion 400 may be non-integrally connected to the second portion 500. Moving the first portion from a first position to a second position allows the lid 104 to be moved from a closed position to an open position relative to the frame 300. The closure system 110 may be provided to the body 200 with the lid 104 in the closed position. The closure system 110 may be provided to the body 200 with the lid 104 in the open position; the lid 104 is then moved to the closed position.

The present disclosure relates to processes for making closure systems 110. The process can include the following steps: providing a first portion 400 (e.g., a dial) as described above; providing a second portion 500 (e.g., a cover) as described above; and connecting the first and second portions 400, 500 to each other. The process may further comprise providing a frame 300. The frame 300 may be hingedly connected to the second portion 500. The frame 300 and second portion 500 may be provided as a single piece, for example, by being molded as a single piece. The process may further comprise the step of providing a biasing means 130 that biases the second portion 500 to an open position from a closed position. The biasing means may be an elastic insert 132, for example a thermoplastic elastomer insert, which may be formed with the frame 300 and/or second portion 500 by insert molding techniques (e.g., bi-injection molding) known to one of ordinary skill. The frame 300 and second portion 500 may be provided in an open position and then moved to a closed position.

The present disclosure relates to a method of loading container systems 100 into a case. A plurality of container systems 100, 150 according to the present disclosure is provided. A first container system 100 is transferred to a box; a second container system 150 is transferred to the box. The first and second container systems 100, 150 may be transferred by a robot. The robot may have one or more arms. The arms may be configured to fit the shape of the container. The robot may lift the container systems. When lifting the container system 100, the robot may grip the side walls of the container body 200. When lifting the container system 100, the arms of the robot may be placed under a ledge near the rim 232 of the container body 200 and lift, coming into contact with the ledge. The arms of the robot may be placed at the concave portions of the side walls 222, 223. The concave shape may result in a ledge having a deeper dimension, thereby providing a larger surface by which to be lifted by a robot arm.

The present disclosure relates to processes for accessing container systems 100. The process can include the following steps: providing a container system 100 according to the present disclosure; moving a first portion 400 (e.g., a dial) of the lid 104 from a first position to a second position relative to a second portion 500 (e.g., a cover) of the lid 104; moving the lid 104 from a closed position to an open position to allow access to a storage volume 210 of the container body 200. The process may include pressing push pads 410, 411 of the first portion 400 radially inward and/or rotating the first portion 400 relative to the second portion 500. The container system 100 may include biasing means 130 that automatically lift the lid 104 from the closed position to the open position, optionally following activation of the biasing means 104 upon the first opening. The process may include removing at least some material, such as a unitized dose article 600, from the storage volume 210. The process may include reclosing the lid 104 by moving it from the open position to the closed position. The container system 100 may provide a signal (e.g., an audible signal such as a "click") when the lid 104 is properly in the closed position.

COMBINATIONS

Specifically contemplated combinations of the disclosure are herein described in the following lettered paragraphs. These combinations are intended to be illustrative in nature and are not intended to be limiting.

A. A container system comprising: a container with an opening that provides access to a storage volume; and a lid hingedly connected to the container, the lid having a closed position in which the lid covers the opening and an open position in which the lid does not cover the opening, the lid having a first portion and a second portion, wherein the first portion is non-integrally connected to the second portion, and wherein moving the first portion from a first position to a second position allows the lid to be moved from the closed position to the open position.

B. The container system of paragraph A, wherein the container comprises a body and a frame that is connectable to the body.

C. The container system of paragraph B, wherein the lid is hingedly connected to the frame.

D. The container system of any of paragraphs A-C, wherein the second portion includes a top wall having an outwardly facing outer surface and an inner surface opposite the outer surface, wherein the first portion faces the inner surface of the second portion.

E. The container system of any of paragraphs A-D, wherein the first portion has a smaller periphery than the second portion.

F. The container system of any of paragraphs A-E, wherein the first portion comprises a push pad, preferably two push pads.

G. The container system of paragraph F, wherein the push pad, when pressed, is moveable radially inwards towards a center axis.

H. The container system of any of paragraphs A-G, wherein the second portion comprises at least one aperture through which at least one push pad is accessible.

I. The container system of any of paragraphs A-H, wherein the first portion is rotatable relative to the second portion.

J. The container system of any of paragraphs A-I, where the first portion is prevented from rotating relative to the second portion until at least one push pad on the first portion is pressed.

K. The container system of any of paragraphs A-J, wherein the second portion includes projections that prevent rotation of the first portion until the push pad is pressed.

L. The container system of any of paragraphs A-K, wherein the lid is configured so that the first portion automatically returns to the first position after movement to the second position.

M. The container system of paragraph L, wherein the first portion, the second portion, or both comprise a biasing structure that returns the first portion to the first position after movement to the second position.

N. The container system of paragraph M, wherein the first portion comprises the biasing structure.

O. The container system of paragraph M, wherein the biasing structure comprises a spring system.

P. The container system of any of paragraphs A-O, wherein the lid comprises a first engagement member, and wherein the container comprises a second engagement member that lockably engages with the first engagement member when the lid is in the closed position, and wherein moving the first portion from the first position to the second position allows the engagement members to disengage.

Q. The container system of any of paragraphs A-P, wherein the first portion comprises, preferably integrally comprises, the first engagement member.

R. The container system of any of paragraphs A-Q, wherein the first engagement member is a latch, and the second engagement member is a catch.

S. The container system of any of paragraphs A-R, wherein the closure system includes biasing means that biases the lid in the open position so that when the first and second engagement members are not engaged, the lid is urged to the open position.

T. The container system of any of paragraphs A-S, wherein the closure system includes biasing means that biases the lid in the open position.

U. The container system of any of paragraphs A-T, wherein the biasing means is a thermoplastic elastomer.

V. The container system of any of paragraphs A-U, wherein the open position is predetermined, and the angle $\theta$ formed by the relative positions of the lid in the closed position compared to the open position is from about 90° to about 150°, or from about 110° to about 135°.

W. The container system of any of paragraphs A-V, wherein the container contains a consumer product, preferably a household care product, preferably a cleaning composition, more preferably a cleaning composition in the form of a unitized dose article.

X. A container system comprising: a container with an opening that provides access to a storage volume, and a closure system, the closure system comprising a cover and optionally a frame, the cover being hingedly connected to the container or optional frame and moveable from a closed position that blocks access to the storage volume and an open position that allows access to the storage volume, and a dial rotatably connected to the cover, the dial having at least one push pad, the dial having at least one engagement structure removeably engageable with the container or optional frame, where the engagement structure, when engaged with the container or optional frame, prevents the lid from moving from the closed position to the open position, where pressing on the push pad allows the dial to rotate relative to the cover and thereby disengage the engagement structure with the container or optional frame to allow the cover to be moveable to the open position.

Y. A container system according to paragraph X, wherein the dial comprises two push pads.

Z. The container system of any of paragraphs X-Y, wherein the container contains a consumer product, preferably a household care product, preferably a cleaning composition, more preferably a cleaning composition in the form of a unitized dose article.

AA. A closure system comprising a lid hingedly connected to a frame, the frame configured to be connectable to an open end of a container, and the lid comprising a first portion and a second portion, wherein the first portion is non-integrally connected to the second portion, and wherein moving the first portion from a first position to a second position allows the lid to be moved from a closed position to an open position relative to the frame.

AB. A process of filling a container system with a material, the process comprising the following steps: providing a container body, where the body includes a storage volume; providing a material to the storage volume; providing a closure system to the body, wherein the closure system includes a lid hingedly connected to a frame, the frame being connectable to an open end of the container body, the lid comprising a first portion and a second portion, the first portion being non-integrally connected to the second portion, where moving the first portion from a first position to a second position allows the lid to be moved from a closed position to an open position relative to the frame.

AC. A process of making a closure system, the process comprising the following steps: providing a cover and a frame, wherein the cover is hingedly connected to the frame; connecting a rotatable dial to the cover to form a closure system.

AD. The process of making a closure system according to paragraph AC, wherein the frame and the second portion are molded as a single piece.

AE. The process of making a closure system according to any of paragraphs AC-AD, wherein the process further comprises providing a biasing means that biases the cover second portion to an open position from a closed position relative to the frame.

AF. The process of making a closure system according to paragraph AE, wherein the biasing means is an elastic insert that is provided to the cover and frame by insert molding.

AG. A process of accessing a container system, the process comprising the following steps: providing a container system according to any of paragraphs A-Z; moving the first portion of the lid from the first position to the second position relative to the second portion; moving the lid from the closed position to the open position; removing at least some material from the storage volume; closing the container system by moving the lid from the open position to the closed position.

AH. The process of accessing a container system according to paragraph AG, wherein the container system provides a signal, preferably an audible signal, when the lid is properly moved to the closed position from the open position.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container system comprising: a container with an opening that provides access to a storage volume; and a lid hingedly connected to the container, the lid having a closed position in which the lid covers the opening and an open position in which the lid does not cover the opening, the lid having a first portion and a second portion, wherein the first portion is non-integrally connected to the second portion, and wherein moving the first position to a second position allows the lid to be moved from the closed position to the open position wherein the lid comprises a first engagement member, and wherein the container comprises a second engagement member that lockably engages with the first engagement member when the lid is in the closed position, and wherein moving the first portion from the first position to the second position allows the engagement members to disengage.

2. The container system of claim 1, wherein the container comprises a body and a frame that is connectable to the body.

3. The container system of claim 2, wherein the lid is hingedly connected to the frame.

4. The container system of claim 1, wherein the second portion includes a top wall having an outwardly facing outer surface and an inner surface opposite the outer surface, wherein the first portion faces the inner surface of the second portion.

5. The container system of claim 1, wherein the first portion has a smaller periphery than the second portion.

6. The container system of claim 1, wherein the first portion comprises a push pad.

7. The container system of claim 6, wherein the push pad, when pressed, is moveable radially inwards towards a center axis.

8. The container system of claim 1, wherein the second portion comprises at least one aperture through which at least one push pad is accessible.

9. The container system of claim 1, wherein the first portion is rotatable relative to the second portion.

10. The container system of claim 9, wherein the second portion includes projections that prevent rotation of the first portion until the push pad is pressed.

11. The container system of claim 1, wherein the first portion, the second portion, or both comprise a biasing structure that returns the first portion to the first position after movement to the second position.

12. The container system of claim 11, wherein the first portion comprises the biasing structure.

13. The container system of claim 1, wherein the first portion comprises the first engagement member.

14. The container system of claim 13, wherein the first engagement member is a latch, and the second engagement member is a catch.

15. The container system of claim 14, wherein the closure system includes biasing means that biases the lid in the open position so that when the first and second engagement members are not engaged, the lid is urged to the open position.

16. The container system of claim 1, wherein the closure system includes biasing means that biases the lid in the open position.

17. The container system of claim 16, wherein the biasing means is a thermoplastic elastomer.

18. The container system of claim 1, wherein the open position is predetermined, and the angle θ formed by the relative positions of the lid in the closed position compared to the open position is from about 90° to about 150°.

19. The container system of claim 1, wherein the container contains a household care product.

* * * * *